US008165483B2

(12) United States Patent
Shiori

(10) Patent No.: US 8,165,483 B2
(45) Date of Patent: Apr. 24, 2012

(54) IMAGE FORMING APPARATUS WITH CONTROL UNIT AND FOR CONTROL METHOD FOR CONTROLLING THE SAME

(75) Inventor: Jun Shiori, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 442 days.

(21) Appl. No.: 12/437,836

(22) Filed: May 8, 2009

(65) Prior Publication Data

US 2009/0279910 A1 Nov. 12, 2009

(30) Foreign Application Priority Data

May 9, 2008 (JP) ..... 2008-122965
Apr. 8, 2009 (JP) ..... 2009-093751

(51) Int. Cl.
*G03G 15/00* (2006.01)

(52) U.S. Cl. ..... 399/38; 399/50; 399/51; 399/53; 399/75

(58) Field of Classification Search ..... 399/38, 399/50, 51, 53, 75
See application file for complete search history.

(56) References Cited

U.S. PATENT DOCUMENTS 4,330,199 A 5/1982 Komori et al.
2002/0061203 A1 5/2002 Akaike et al.
2006/0072945 A1* 4/2006 Ide ..... 399/327
2007/0052998 A1 3/2007 Tsunekawa
2007/0122164 A1 5/2007 Shiori et al.
2007/0122166 A1 5/2007 Takahashi et al.
2007/0122167 A1 5/2007 Sugiyama et al.

FOREIGN PATENT DOCUMENTS

JP 2003-307990 10/2003
JP 2006-285294 10/2006
JP 2007-69357 3/2007
JP 2007-79316 3/2007

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

An image forming apparatus including a latent image bearing member a surface of which is rotated, a charging device, an irradiating device, a developing device, a transfer device, and a control unit. The control unit controls the image forming apparatus to perform subsequent image formation in accordance with a subsequent image forming request when determining that the subsequent image forming request is present at a predetermined determination time after completion of previous image formation, and controls the image forming apparatus to shut down certain predetermined operations including at least rotation of the surface of the latent image bearing member and application of a charging bias from the charging device and a developing bias from the developing device in accordance with a predetermined shutdown sequence when determining that the subsequent image forming request is not present at the predetermined determination time.

16 Claims, 20 Drawing Sheets

IMAGE FORMING APPARATUS WITH CONTROL UNIT AND FOR CONTROL METHOD FOR CONTROLLING THE SAME

CROSS-REFERENCE TO RELATED APPLICATIONS

The present patent application is based on and claims priority pursuant to 35 U.S.C. §119 from Japanese Patent Application Nos. 2008-122965, filed on May 9, 2008 in the Japan Patent Office, and 2009-093751, filed on Apr. 8, 2009 in the Japan Patent Office, the entire contents of each of which are incorporated herein by reference.

BACKGROUND OF THE INVENTION

1. Field of the Invention

Exemplary aspects of the present invention generally relate to an image forming apparatus such as a copier, a facsimile machine, or a printer that performs image formation by transferring a toner image formed on a surface of an image bearing member onto a recording medium, and a control method for controlling the image forming apparatus.

2. Description of the Background

Related-art image forming apparatuses, such as a copier, a facsimile machine, a printer, or a multifunction printer having two or more of copying, printing, scanning, and facsimile functions, form a toner image on a recording medium (e.g., a sheet) according to image data using an electrophotographic method. In such a method, for example, a charger charges a surface of an image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Such image forming apparatuses generally determine whether or not a request for subsequent image formation is present at a predetermined determination time (hereinafter referred to as shutdown determination time) after completion of a current image formation operation. When determining that the request for subsequent image formation is not present, the image forming apparatuses shut down predetermined operations performed therein in order to prevent abrasion of components and deterioration of toner. Generally, the image forming apparatuses shut down such operations as rotation of the image bearing member and application of a charging bias from the charger and a developing bias from the developing device in accordance with a predetermined shutdown procedure. By contrast, when receiving the request for subsequent image formation, the image forming apparatuses start up the operations thus shut down so that subsequent image formation is started in accordance with the request.

As is obvious, it requires time to shut down or start up the operations. Further, new image formation cannot be started while the operations are shut down or started up. Consequently, in a case in which the request for subsequent image formation is received after the process to shut down the operations is started, the start of subsequent image formation is delayed compared with a case in which the request is received before the process to shut down the operations is started.

Published Unexamined Japanese Patent Application No. (hereinafter referred to as JP-A-) 2007-069357 discloses an image forming apparatus that estimates a time required to process print data during continuous image formation so that output of an image of the first page to a printer engine is delayed depending on the time thus estimated. When image data with a larger processing load is included in continuous image formation, output of a request for forming images based on such image data is delayed. Consequently, the request may not be output before the shutdown determination time after previous image formation is completed. As a result, the printer engine is shut down even during continuous image formation, and start of subsequent image formation based on such image data is delayed for at least the time required to shut down the operations and then restart such operations.

According to the image forming apparatus disclosed in JP-A-2007-069357, even when the image data with a larger processing load is included in continuous image formation, output of the image of the first page to the printer engine is delayed only for a time corresponding to the time required to process the image data. Accordingly, the printer engine is prevented from being shut down during continuous image formation. As a result, downtime caused by shutdown of the printer engine during continuous image formation can be reduced.

When determining that the request for subsequent image formation is not present at the shutdown determination time, related-art image forming apparatuses such as the image forming apparatus disclosed in JP-A-2007-069357 enter the shutdown sequence to shut down the predetermined operations. The shutdown sequence is not suspended, but continued until completed even when the request for subsequent image formation is received during the shutdown sequence. Consequently, in a case in which the request for subsequent image formation is received during the shutdown sequence, start of subsequent image formation in accordance with the request is delayed for the time required to perform the rest of the shutdown sequence and then the startup sequence performed after completion of the shutdown sequence.

SUMMARY

In view of the foregoing, illustrative embodiments of the present invention provide an image forming apparatus capable of reducing waiting time until start of subsequent image formation even when a request for subsequent image formation is received during a shutdown sequence, and a control method for controlling the image forming apparatus.

In one illustrative embodiment, an image forming apparatus includes a latent image bearing member a surface of which is rotated to bear an electrostatic latent image, a charging device to evenly charge the surface of the latent image bearing member, an irradiating device to irradiate a charged surface of the latent image bearing member with a light beam according to image data to form an electrostatic latent image thereon, a developing device to develop the electrostatic latent image with a developer to form a toner image on the charged surface of the latent image bearing member, a transfer device to transfer the toner image onto a recording medium to form an image on the recording medium, and a control unit to control the image forming apparatus to perform subsequent image formation in accordance with a subsequent image forming request when determining that the subsequent image forming request is present at a predetermined determination time after completion of previous image formation, and control the image forming apparatus to shut down certain predetermined operations including at least rotation of the surface of the latent image bearing member and application of a charging bias from the charging device and a developing bias from the developing device in accordance with a predetermined shutdown sequence when determining that the subsequent image forming request is not present at the predetermined determination time. The control unit controls the image forming apparatus to start subsequent image formation in accordance with the subsequent image forming request without stopping rotation of the surface of the latent image bearing member when the subsequent image forming request is received during the time between when the control unit determines that the subsequent image forming request is not present at the predetermined determination time and when a process to stop rotation of the surface of the latent image bearing member is completed.

Another illustrative embodiment provides a control method for controlling an image forming apparatus. The image forming apparatus includes a latent image bearing member a surface of which is rotated to bear an electrostatic latent image, a charging device to evenly charge the surface of the latent image bearing member, an irradiating device to irradiate a charged surface of the latent image bearing member with a light beam according to image data to form an electrostatic latent image thereon, a developing device to develop the electrostatic latent image with a developer to form a toner image on the charged surface of the latent image bearing member, and a transfer device to transfer the toner image onto a recording medium to form an image on the recording medium. The control method includes the steps of: (a) determining whether or not a subsequent image forming request is present at a predetermined determination time after completion of previous image formation; (b) upon determining that the subsequent image forming request is not present at the predetermined determination time, shutting down certain predetermined operations including at least rotation of the surface of the latent image bearing member and application of a charging bias from the charging device and a developing bias from the developing device in accordance with a predetermined shutdown sequence; and (c) starting subsequent image formation in accordance with the subsequent image forming request without stopping rotation of the surface of the latent image bearing member when the subsequent image forming request is received during a time between when determining that the subsequent image forming request is not present at the predetermined determination time and when a process to stop rotation of the surface of the latent image bearing member is completed.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
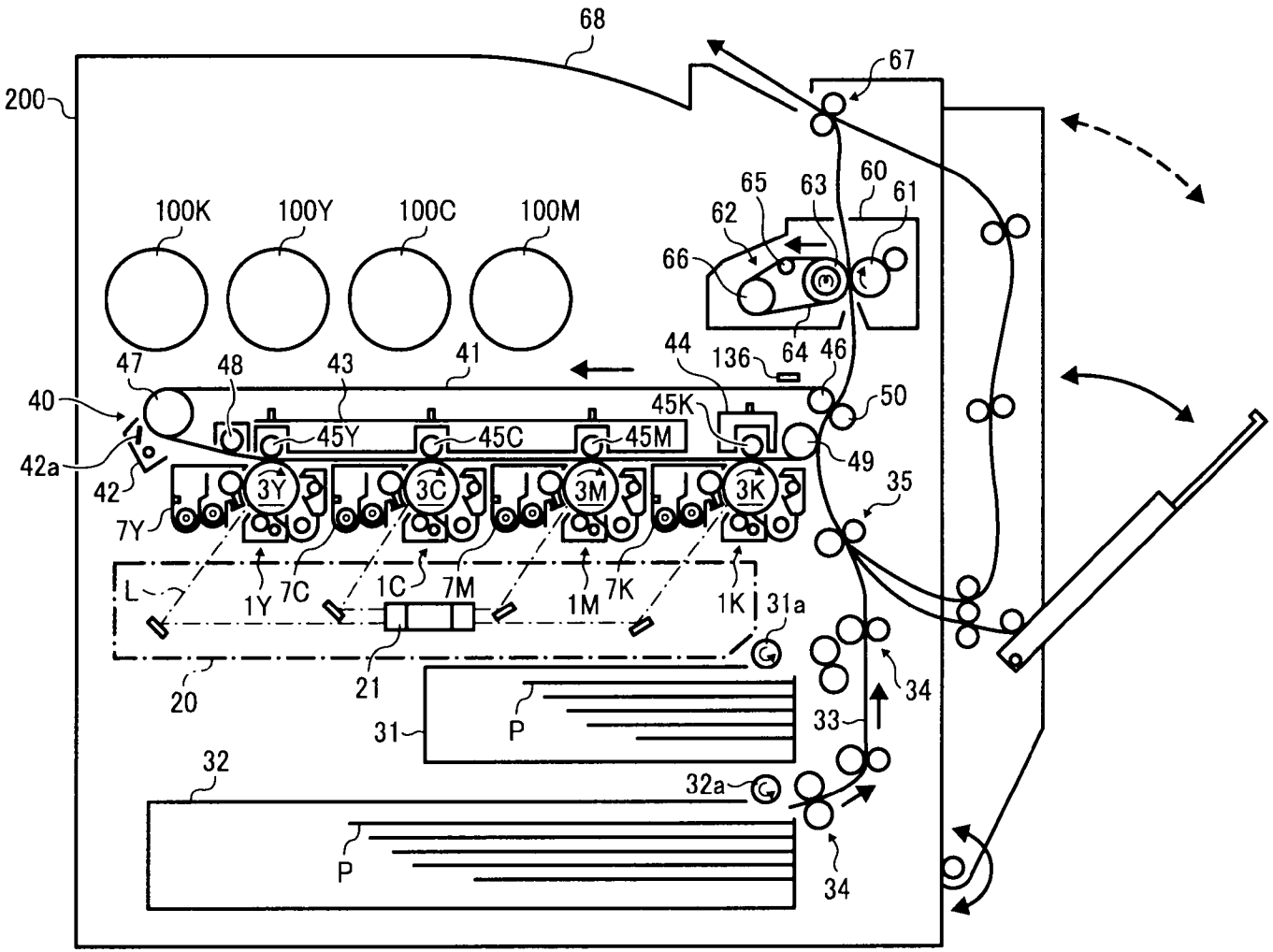
FIG. 1 is a schematic view illustrating an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a printer using an electrophotographic method (hereinafter referred to as an image forming apparatus 200) according to illustrative embodiments.

FIG. 1 is a schematic view illustrating the image forming apparatus 200. The image forming apparatus 200 includes four process units 1Y, 1C, 1M, and 1K (hereinafter collectively referred to as process units 1) of a specific color, specifically yellow (Y), cyan (C), magenta (M), or black (K), each serving as toner image forming means. Each of the process units 1 has the same configuration except that a different color of toner of yellow, cyan, magenta, or black is used as a image forming material.

A configuration of the process unit 1Y for forming yellow toner images is described in detail below as an example of the process units 1 included in the image forming apparatus 200.

Figure 2:
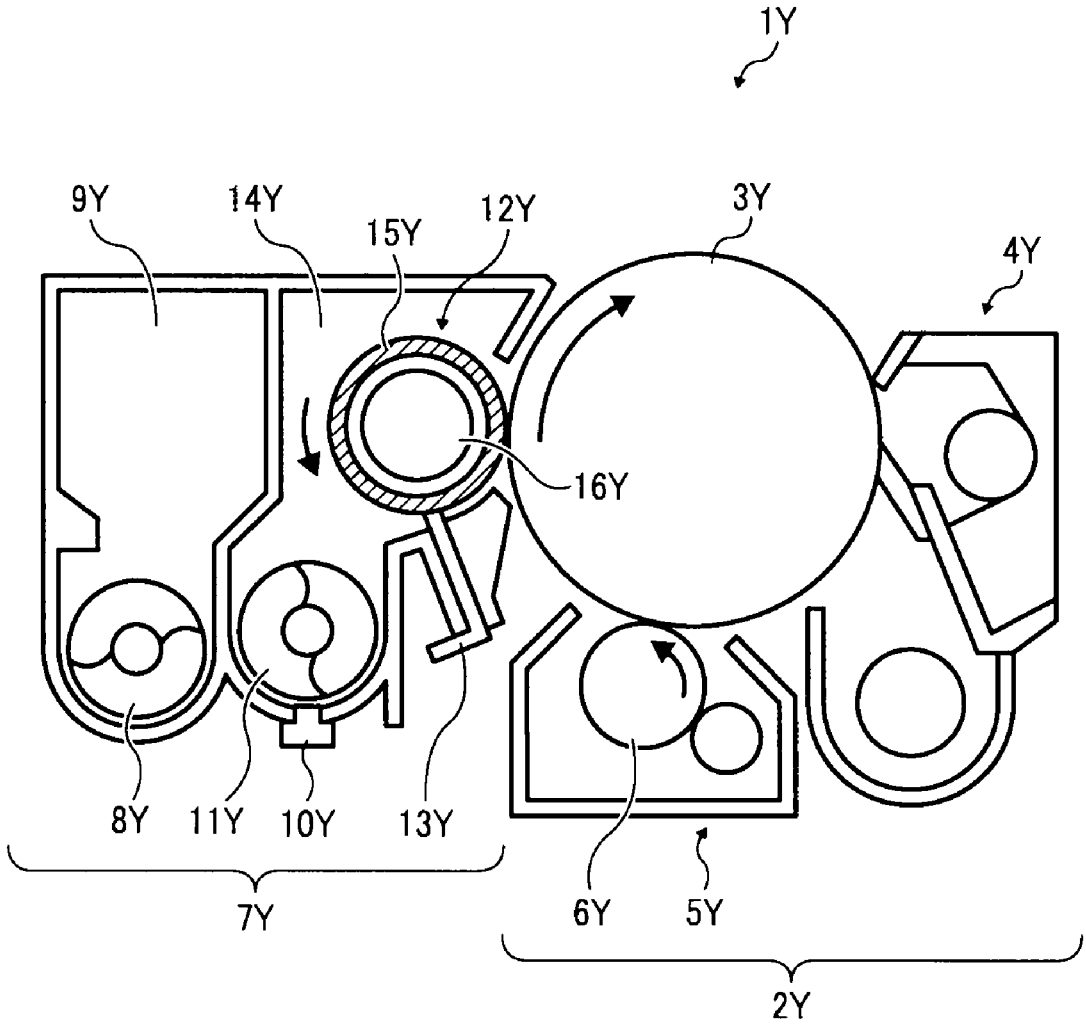
FIG. 2 is a schematic view illustrating a process unit included in the image forming apparatus.
Figure 3:
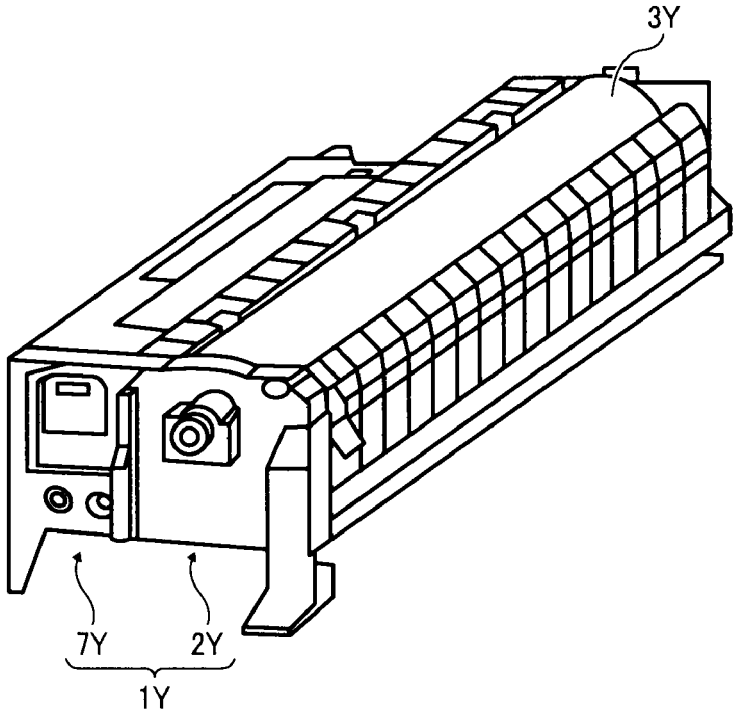
FIG. 3 is a perspective view illustrating the process unit.
Figure 4:
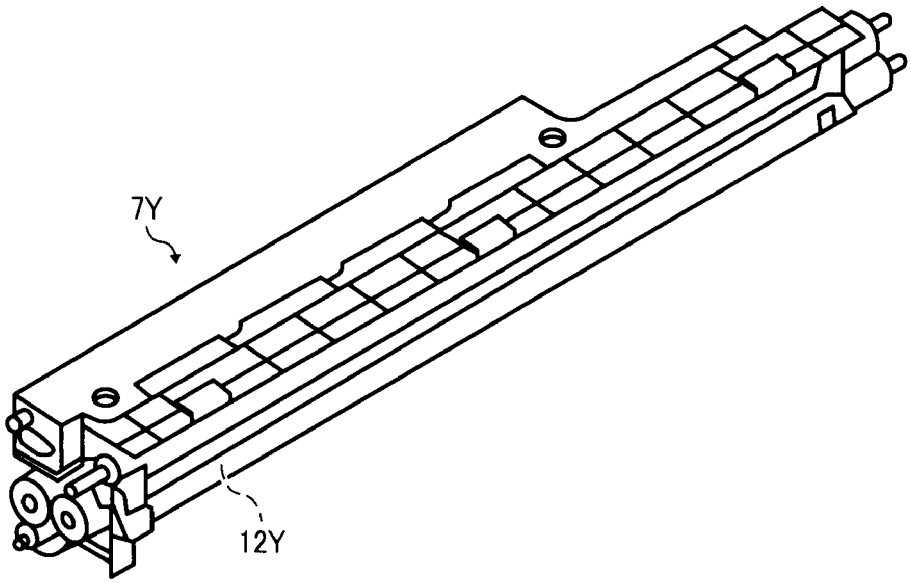
FIG. 4 is a perspective view illustrating a developing unit included in the process unit.

FIG. 2 is a schematic view illustrating the process unit 1Y. Referring to FIG. 2, the process unit 1Y includes a photoconductor unit 2Y and a developing unit 7Y. The photoconductor unit 2Y and the developing unit 7Y are integrally detachably attached to the image forming apparatus 200 as the process unit 1Y as illustrated in FIG. 3. When the process unit 1Y is detached from the image forming apparatus 200, the developing unit 7Y is detachably attached to the photoconductor unit 2Y as illustrated in FIGS. 3 and 4.

Returning to FIG. 2, the photoconductor unit 2Y includes a drum-shaped photoconductor 3Y, a drum cleaning device 4Y, a neutralizing device, not shown, a charger 5Y, and so forth.

The charger 5Y serving as charging means evenly charges a surface of the photoconductor 3Y rotated by drive means, not shown, in a clockwise direction in FIG. 2. A charging roller 6Y included in the charger 5Y is rotated in a counterclockwise direction in FIG. 2 while being supplied with a charging bias from a power source, not shown. The charging roller 6Y contacts the photoconductor 3Y to evenly charge the surface of the photoconductor 3Y. In place of the charging roller 6Y, a charging brush contacting the photoconductor 3Y may be included in the charger 5Y to evenly charge the surface of the photoconductor 3Y. Alternatively, the surface of the photoconductor 3Y may be evenly charged by a scorotron charger. The surface of the photoconductor 3Y evenly charged by the charger 5Y is directed by laser light emitted from an optical writing unit 20 to be described in detail later to bear an electrostatic latent image for a color of yellow.

The developing unit 7Y serving as developing means includes a first developer container 9Y including a first conveyance screw 8Y serving as an agitation member. The developing unit 7Y further includes a second developer container 14Y including a toner density sensor 10Y including a magnetic permeability sensor, a second conveyance screw 11Y serving as an agitation member, a developing roller 12Y serving as a developer bearing member, and a doctor blade 13Y. Each of the first and second developer containers 9Y and 14Y stores yellow developer, not shown, including a magnetic carrier and negatively charged yellow toner. The first conveyance screw 8Y is rotated by drive means, not shown, to convey the yellow developer stored in the first developer container 9Y from near to far in a direction perpendicular to the surface of the sheet of paper on which FIG. 2 is drawn. The yellow developer is then conveyed to the second developer container 14Y through a connection opening, not shown, provided on a partition between the first developer container 9Y and the second developer container 14Y.

The second conveyance screw 11Y provided in the second developer container 14Y is rotated by drive means, not shown, to convey the yellow developer stored in the second developer container 14Y from far to near in a direction perpendicular to the surface of the sheet of paper on which FIG. 2 is drawn. The toner density sensor 10Y fixed to the bottom of the second developer container 14Y detects a toner density of the yellow developer being conveyed in the second developer container 14Y. The developer roller 12Y is provided above the second conveyance screw 11Y in parallel to each other. The developer roller 12Y includes a developing sleeve 15Y including a non-magnetic pipe rotated in a counterclockwise direction in FIG. 2. The developer sleeve 15Y includes a magnet roller 16Y. A part of the yellow developer conveyed by the second conveyance screw 11Y is attracted to a surface of the developing sleeve 15Y due to a magnetic force generated by the magnet roller 16Y. The doctor blade 13Y provided with a predetermined interval from the developing sleeve 15Y restricts a thickness of the yellow developer on the surface of the developing sleeve 15Y. Thereafter, the yellow developer on the surface of the developing sleeve 15Y is conveyed to a developing area where the developing sleeve 15Y faces the photoconductor 3Y, and is supplied to the electrostatic latent image for a color of yellow formed on the surface of the photoconductor 3Y. Accordingly, a yellow toner image is formed on the surface of the photoconductor 3Y. The yellow developer of which toner is consumed by development is returned to the second conveyance screw 11Y along with rotation of the developing sleeve 15Y of the developing roller 12Y. Thereafter, the yellow developer is returned to the first developer container 9Y through the connection opening.

The toner density of the yellow developer detected by the toner density sensor 10Y is sent to a control unit 140 as a voltage signal. The control unit 140 includes a central processing unit (CPU) serving as operation means, a random access memory (RAM) serving as data storing means, a read-only memory (ROM), and so forth to implement a variety of processing and control programs. The toner density sensor 10Y outputs a voltage corresponding to the toner density of the yellow developer thus detected. As described above, the control unit 140 includes the RAM to store data on a target value of the voltage (Vtref for a color of yellow) output from the toner density sensor 10Y, and target values of the voltage (Vtref for each color of cyan, magenta, and black) respectively output from the toner density sensors 10 provided in the developing units 7 of respective colors. In the developing unit 7Y, the value of the voltage output from the toner density sensor 10Y and Vtref for a color of yellow are compared to each other so that a toner supply device for a color of yellow, not shown, is driven for a time corresponding to the result of the comparison. Accordingly, an appropriate amount of the yellow toner is supplied to the yellow developer in the first developer container 9Y, of which toner density is decreased due to toner consumption for development. As a result, the toner density of the yellow developer stored in the second developer container 14Y is kept within a predetermined range. Toner supply is controlled in the same way for the developer of other colors stored in the process units 1C, 1M, and 1K.

The yellow toner image formed on the photoconductor 3Y is intermediately transferred onto an intermediate transfer belt 41 serving as a transfer member. The drum cleaning device 4Y of the photoconductor unit 2Y removes residual toner from the surface of the photoconductor 3Y after the yellow toner image is intermediately transferred onto the intermediate transfer belt 41. Thereafter, the surface of the photoconductor 3Y is neutralized by the neutralizing device, not shown. As a result, the surface of the photoconductor 3Y is initialized to be ready for subsequent image formation. In the process units 1C, 1M, and 1K illustrated in FIG. 1, toner images of the colors of cyan, magenta, and black are formed on the photoconductor 3C, 3M, and 3K, respectively, and those toner images are intermediately transferred onto the intermediate transfer belt 41 in the same manner as the case of the yellow toner image as described above. It should be noted that the neutralizing device is not necessarily provided in the image forming apparatus 200 in a case in which neutralization is not performed or the optical writing unit 20 to be described in detail later is used for neutralization.

Returning to FIG. 1, the optical writing unit 20 is provided below the process units 1. The optical writing unit 20 serves as an irradiating device for forming latent images, and directs laser light L to the photoconductors 3Y, 3C, 3M, and 3K (hereinafter collectively referred to as photoconductors 3) in the process units 1 based on image data. As a result, electrostatic latent images of each color of yellow, cyan, magenta, and black are formed on the photoconductors 3, respectively. It is to be noted that the optical writing unit 20 directs the laser light L to the photoconductors 3 via multiple optical lenses and mirrors by deflecting the laser light L emitted from a light source using a polygon mirror 21 rotated by a motor. In place of the above-described configuration, an LED array may be used for optical scanning.

A first paper feed cassette 31 and a second paper feed cassette 32 are provided one above the other in a vertical direction below the optical writing unit 20. A stack of multiple recording sheets P each serving as a recording medium is stored in each of the first and second paper feed cassettes 31 and 32, and each of a first paper feed roller 31*a* and a second paper feed roller 32*a* is pressed against the recording sheet P placed on the top of each stack. When the first paper feed roller 31*a* is rotated in a counterclockwise direction in FIG. 1 by drive means, not shown, the recording sheet P on the top of the stack in the first paper feed cassette 31 is conveyed to a paper feed path 33 extending in a vertical direction on the right of the first and second paper feed cassettes 31 and 32 in FIG. 1. Similarly, when the second paper feed roller 32*a* is rotated in a counterclockwise direction in FIG. 1 by drive means, not shown, the recording sheet P on the top of the stack in the second paper feed cassette 32 is conveyed to the paper feed path 33. Multiple pairs of conveyance rollers 34 are provided in the paper feed path 33, and the recording sheet P conveyed to the paper feed path 33 is sandwiched between the pairs of the conveyance rollers 34 and conveyed upward through the paper feed path 33.

A pair of registration rollers 35 is provided at the end of the paper feed path 33. Rotation of the pair of registration rollers 35 is temporarily stopped immediately after the recording sheet P conveyed from the pair of the conveyance rollers 34 is sandwiched by the pair of registration rollers 35. Thereafter, the pair of the registration rollers 35 conveys the recording sheet P to a secondary transfer nip to be described in detail later at an appropriate time.

A transfer unit 40 including the intermediate transfer belt 41 seamlessly rotated in a counterclockwise direction in FIG. 1 is provided above the process units 1. The transfer unit 40 further includes a belt cleaning unit 42, a first bracket 43, a second bracket 44, four primary transfer rollers 45Y, 45C, 45M, and 45K (hereinafter collectively referred to as primary transfer rollers 45) each serving as primary transfer means, a secondary transfer backup roller 46, a drive roller 47, an auxiliary roller 48, and a tension roller 49. The intermediate transfer belt 41 is stretched by the above-described eight rollers, and is seamlessly rotated in a counterclockwise direction in FIG. 1 along with rotation of the drive roller 47. The intermediate transfer belt 41 is sandwiched between each of the four primary transfer rollers 45Y, 45C, 45M, and 45K and each of the photoconductors 3Y, 3C, 3M, and 3K to form primary transfer nips therebetween, respectively. Each of the primary transfer rollers 45 applies a transfer bias having a polarity opposite to that of the toner, for example, a positive transfer bias, to a back surface of the intermediate transfer belt 41, that is, an inner circumferential surface of a loop of the intermediate transfer belt 41. When the intermediate transfer belt 41 sequentially passes through each of the primary transfer nips along with rotation thereof, the toner images of each color of yellow, cyan, magenta, and black formed on each of the photoconductors 3 are primarily transferred onto an outer circumferential surface of the loop of the intermediate transfer belt 41. As a result, the toner images of each color of yellow, cyan, magenta, and black are superimposed on one another on the intermediate transfer belt 41 to form a full-color toner image.

The intermediate transfer belt 41 is sandwiched by the secondary transfer backup roller 46 and a secondary transfer roller 50 serving as secondary transfer means provided outside of the loop of the intermediate transfer belt 41 so that a secondary transfer nip is formed between the secondary transfer backup roller 46 and the secondary transfer roller 50. The pair of registration rollers 35 conveys the recording sheet P sandwiched therebetween to the secondary transfer nip in synchronization with the full-color toner image formed on the intermediate transfer belt 41. The full-color toner image formed on the intermediate transfer belt 41 is secondarily transferred onto the recording sheet P at the secondary transfer nip due to a pressure and a secondary transfer magnetic field formed between the secondary transfer backup roller 46 and the secondary transfer roller 50 to which a secondary transfer bias is applied. Accordingly, the full-color toner image is formed on the recording sheet P.

The toner which is not transferred onto the recording sheet P remains on the intermediate transfer belt 41 after the intermediate transfer belt 41 passes through the secondary transfer nip. Such toner is removed from the intermediate transfer belt 41 by the belt cleaning unit 42. A cleaning blade 42*a* included in the belt cleaning unit 42 contacts the outer circumferential surface of the intermediate transfer belt 41 to remove the toner remaining on the intermediate transfer belt 41.

The first bracket 43 is pivoted around a rotary axis of the auxiliary roller 48 at a predetermined rotation angle in accordance with operational states of a solenoid, not shown. When a monochrome image is formed by the image forming apparatus 200, the first bracket 43 is slightly rotated in a counterclockwise direction in FIG. 1 by driving the solenoid to revolve the primary transfer roller 45Y, 45C, and 45M in a counterclockwise direction around the rotary axis of the auxiliary roller 48, so that the intermediate transfer belt 41 is removed from the photoconductors 3Y, 3C, and 3M. Accordingly, only the process unit 1K is driven to form the monochrome image. As a result, unnecessary abrasion of the process units 1Y, 1C, and 1M can be prevented during monochrome image formation.

A fixing unit 60 is provided above the secondary transfer nip in FIG. 1. The fixing unit 60 includes a heat pressing roller 61 including a heat source such as a halogen lamp, and a fixing belt unit 62. The fixing belt unit 62 includes a seamless fixing belt 64 serving as a fixing member, a heat roller 63 including a heat source such as a halogen lamp, a tension roller 65, a drive roller 66, and a temperature sensor, not shown. The fixing belt 64 is stretched by the heat roller 63, the tension roller 65, and the drive roller 66, and is seamlessly rotated in a counterclockwise direction in FIG. 1. While being seamlessly rotated, the fixing belt 64 is heated by the heat roller 63 from a back surface side thereof. The heat pressing roller 61 rotated in a clockwise direction in FIG. 1 is provided opposite the heat roller 63 such that the heat pressing roller 61 contacts an outer circumferential surface of the fixing belt 64. Accordingly, a fixing nip is formed between the heat pressing roller 61 and the fixing belt 64.

The temperature sensor, not shown, is provided outside of a loop of the fixing belt 64. Specifically, the temperature sensor is provided opposite the outer circumferential surface of the fixing belt 64 with a predetermined interval from the fixing belt 64 to detect a temperature of the surface of the fixing belt 64 immediately before the fixing belt 64 enters the fixing nip. The detection result is sent to a fixing power circuit, not shown. The fixing power circuit controls power supply to the heat sources included in the heat roller 63 and the heat pressing roller 61, respectively, based on the detection result sent from the temperature sensor. Accordingly, the temperature of the surface of the fixing belt 64 is kept about 140° C.

The recording sheet P passing through the secondary transfer nip is separated from the intermediate transfer belt 41 and conveyed to the fixing unit 60. In the fixing unit 60, heat and pressure are applied to the recording sheet P while the recording sheet P is conveyed upward in FIG. 1 by being sandwiched by the heat pressing roller 61 and the heat roller 63 at the fixing nip. As a result, the full-color toner image is fixed to the recording sheet P.

The recording sheet P having a full-color image thereon is then conveyed between a pair of discharge rollers 67, and discharged from the image forming apparatus 200. The recording sheet P thus discharged is sequentially stacked on a paper stack 68 provided on an upper surface of a housing of the image forming apparatus 200.

Four toner cartridges 100Y, 100C, 100M, and 100K (hereinafter collectively referred to as toner cartridges 100), each storing toner of a specific color of yellow, cyan, magenta, or black, are provided above the transfer unit 40 as illustrated in FIG. 1. Toner of each color of yellow, cyan, magenta, and black stored in each of the toner cartridges 100Y, 100C, 100M, and 100K is appropriately supplied to each of the developing units 7Y, 7C, 7M, and 7K in each of the process units 1Y, 1C, 1M, and 1K. Each of the toner cartridges 100 is detachably attached to the image forming apparatus 200 separating from the process units 1.

Figure 5:
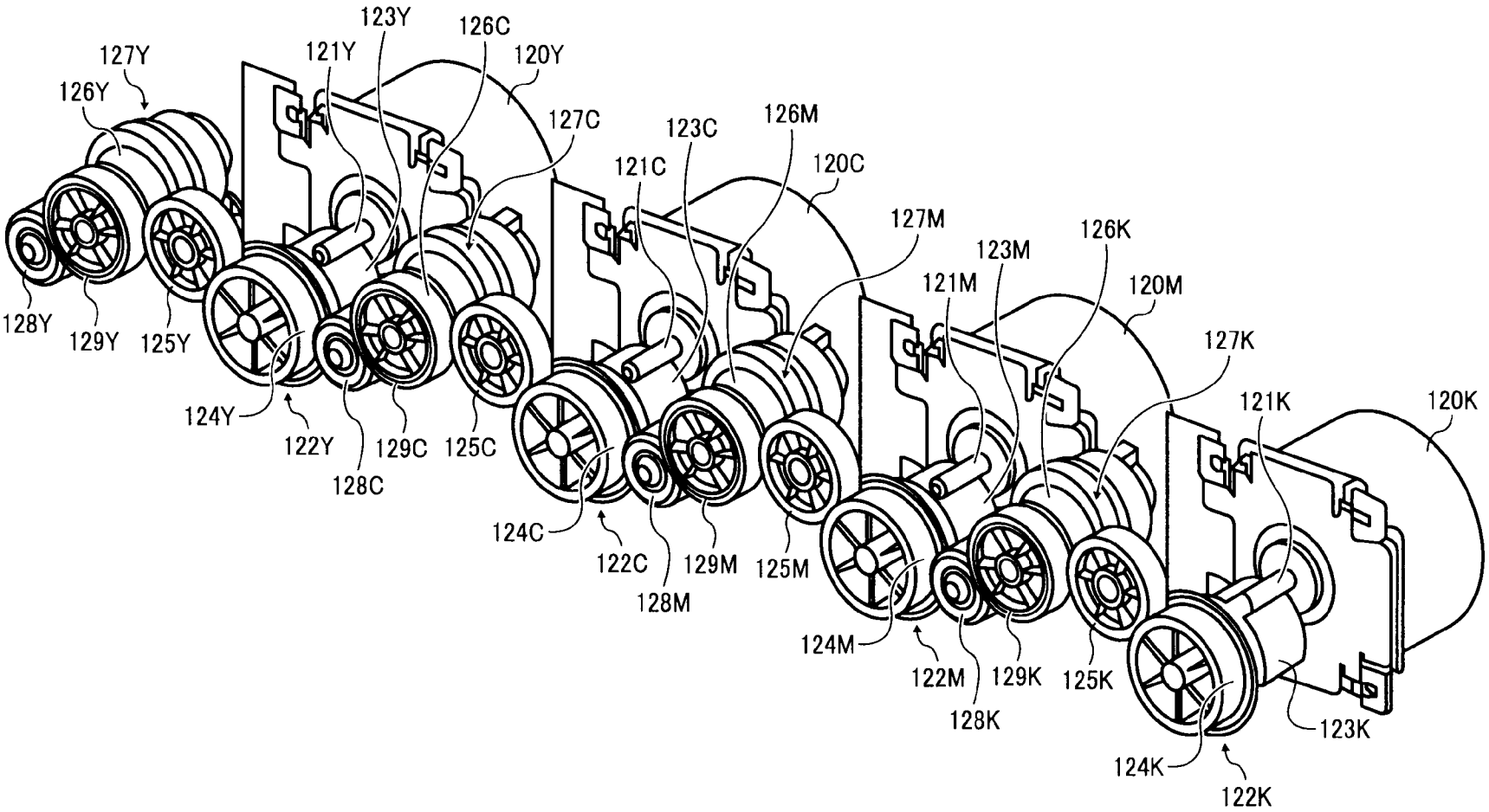
FIG. 5 is a perspective view illustrating a drive transmission system installed in a housing of the image forming apparatus.
Figure 6:
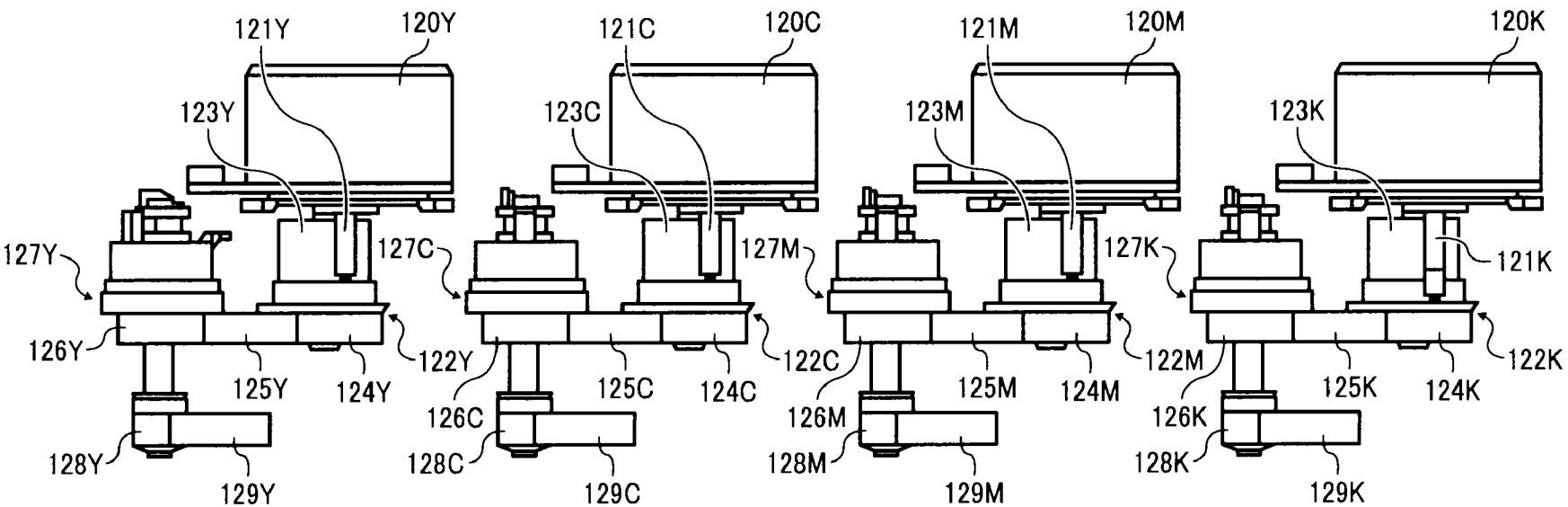
FIG. 6 is a top view illustrating the drive transmission system.

FIG. 5 is a perspective view illustrating a drive transmission system installed in the housing of the image forming apparatus 200. FIG. 6 is a top view illustrating the drive transmission system.

In the housing of the image forming apparatus 200, a planar support is provided in a standing manner, and four process drive motors 120Y, 120C, 120M, and 120K (hereinafter collectively referred to as process drive motors 120) each serving as a driving source are fixed to the planar support. Rotary axes of the process drive motors 120 are respectively connected to drive gears 121Y, 121C, 121M, and 121K (hereinafter collectively referred to as drive gears 121) such that the drive gears 121 are rotated coaxially with the rotary axes of the process drive motors 120.

Developing gears 122Y, 122C, 122M, and 122K (hereinafter collectively referred to as developing gears 122) swingably rotated by engaging with fixing shafts, not shown and protruding from the planar support are provided below the rotary axes of the process drive motors 120. The developing gears 122 include first gears 123Y, 123C, 123M, and 123K (hereinafter collectively referred to as first gears 123), and second gears 124Y, 124C, 124M, and 125K (hereinafter collectively referred to as second gears 124), respectively. The first gears 123 and the second gears 124 are rotated coaxially. Each of the second gears 124 is provided closer to a leading edge of the rotary axis of each of the process drive motors 120 than each of the first gears 123. The developing gears 122 are swingably rotated on the fixing shafts along with rotation of the process drive motors 120 by engaging the first gears 123 with the drive gears 121 of the process drive motors 120.

Each of the process drive motors 120 includes a DC servomotor which is a type of DC brushless motor, a stepper motor, and so forth. A reduction ratio between the drive gears 121 and photoconductor gears 133Y, 133C, 133M, and 133K (hereinafter collectively referred to as photoconductor gears 133) to be described in detail later is, for example, 1 to 20. A driving force is transmitted from the drive gears 122 to the photoconductor gears 133 with single-stage reduction in order to reduce the number of components and thus the cost. In addition, a smaller number of gears, that is, the above-described two gears according to illustrative embodiments, can reduce transmission errors caused by engagement errors and eccentricity.

With the relatively large reduction ratio of 1 to 20, the single-stage reduction requires a diameter of the photoconductor gears 133 to be larger than that of the photoconductors 3. By using the photoconductor gears 133 having such a large diameter, pitch errors on the surfaces of the photoconductors 3 corresponding to engagement of one tooth of the photoconductor gears 133 can be reduced so that uneven print density (banding) is reduced in a sub-scanning direction. In consideration of a relation between the target rotational speed of the photoconductors 3 and characteristics of the process drive motors 120, the reduction speed is determined based on a speed range capable of obtaining higher effectiveness and higher rotational accuracy.

First junction gears 125Y, 125C, 125M, and 125K (hereinafter collectively referred to as first junction gears 125) swingably rotated by engaging with the fixing shafts, not shown, are provided on the right of the developing gears 122. Each of the first junction gears 125 engages with each of the second gears 124 of the developing gears 122. Accordingly, a driving force is applied to the first junction gears 125 from the developing gears 122 so that the first junction gears 125 are swingably rotated on the fixing shafts. In addition the first junction gears 125 being engaged with the second gears 124 on an upstream side relative to a direction of drive transmission, the first junction gears 125 are engaged with clutch input gears 126Y, 126C, 126M, and 126K (hereinafter collectively referred to as clutch input gears 126), respectively, on a downstream side relative to the direction of drive transmission. The clutch input gears 126 are supported by developing clutches 127Y, 127C, 127M, and 127K (hereinafter collectively referred to as developing clutches 127), respectively. The developing clutches 127 transmit a driving force of the clutch input gears 126 to clutch shafts or cause the clutch input gears 126 to idly rotate in accordance with power supply to the developing clutches 127 controlled by the control unit 140. Clutch output gears 128Y, 128C, 128M, and 128K (hereinafter collectively referred to as clutch output gears 128) are fixed to a leading edge of each of the clutch shafts of the developing clutches 127. When power is supplied to the developing clutches 127, the driving force of the clutch input gears 126 is transmitted to the clutch shafts to rotate the clutch output gears 128. By contrast, when power is not supplied to the developing clutches 127, the clutch input gears 126 are idly rotated on the clutch shafts even when the process drive motors 120 are rotated. As a result, rotation of the clutch output gears 128 is stopped.

Second junction gears 129Y, 129C, 129M, and 129K (hereinafter collectively referred to as second junction gears 129) swingably rotated by engaging with the fixing shafts, not shown, are provided on the left of the clutch output gears 128. The second junction gears 129 are rotated by engaging with the clutch output gears 128.

Figure 7:
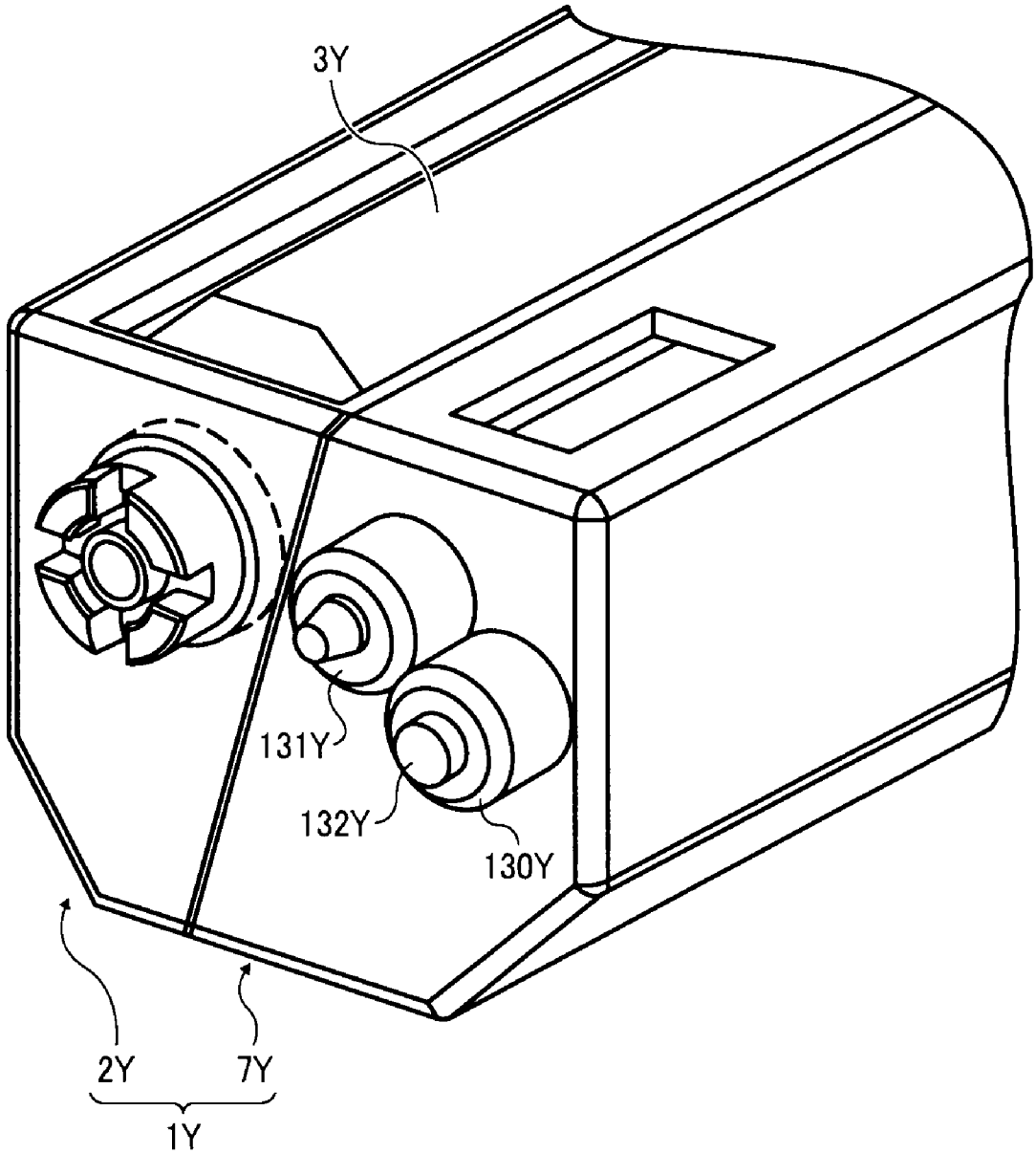
FIG. 7 is a partial perspective view illustrating one edge of the process unit.

FIG. 7 is a partial perspective view illustrating an edge of the process unit 1Y. A shaft of the developing sleeve 15Y provided within the housing of the developing unit 7Y passes through a side surface of the housing so that a part of the developing sleeve 15Y protrudes outside of the housing. A sleeve upstream gear 131Y is fixed to such a part of the developing sleeve 15Y. Further, a fixing shaft 132Y protrudes from the side surface of the housing, and a third junction gear 130Y is engaged with the sleeve upstream gear 131Y while being swingably rotated by engaging with the fixing shaft 132Y.

When the process unit 1Y is attached to the image forming apparatus 200, the third junction gear 130Y is engaged with the second junction gear 129Y illustrated in FIGS. 5 and 6 as well as the sleeve upstream gear 131Y. Accordingly, the driving force of the second junction gear 129Y is sequentially transmitted to the third junction gear 130Y and the sleeve upstream gear 131Y to rotate the developing sleeve 15Y.

Although only the configuration of the process unit 1Y is described in detail above with reference to drawings, the driving force is transmitted to each of the developing sleeves 15C, 15M, and 15K in the process units 1C, 1M, and 1K in the same manner.

Although one edge of the process unit 1Y is illustrated in FIG. 7, the other edge of the shaft of the developing sleeve 15Y also passes through the other side surface of the housing and protrudes outside from the housing. A sleeve downstream gear, not shown, is fixed to the other edge of the shaft of the developing sleeve 15Y. A part of the shaft of each of the first conveyance screw BY and the second conveyance screw 11Y passes through the other side surface of the housing, and a first screw gear, not shown, and a second screw gear, not shown, are fixed to that part, respectively. When the developing sleeve 15Y is rotated by the driving force transmitted from the sleeve upstream gear 131Y, the sleeve downstream gear provided at the other edge of the shaft of the developing sleeve 15Y is also rotated. Accordingly, the second conveyance screw 11Y receiving the driving force from the second screw gear engaged with the sleeve downstream gear is rotated. Further, the first conveyance screw 8Y receiving the driving force from the first screw gear engaged with the second screw gear is rotated.

The process units 1C, 1M, and 1K have the same configuration as described above.

Figure 8:
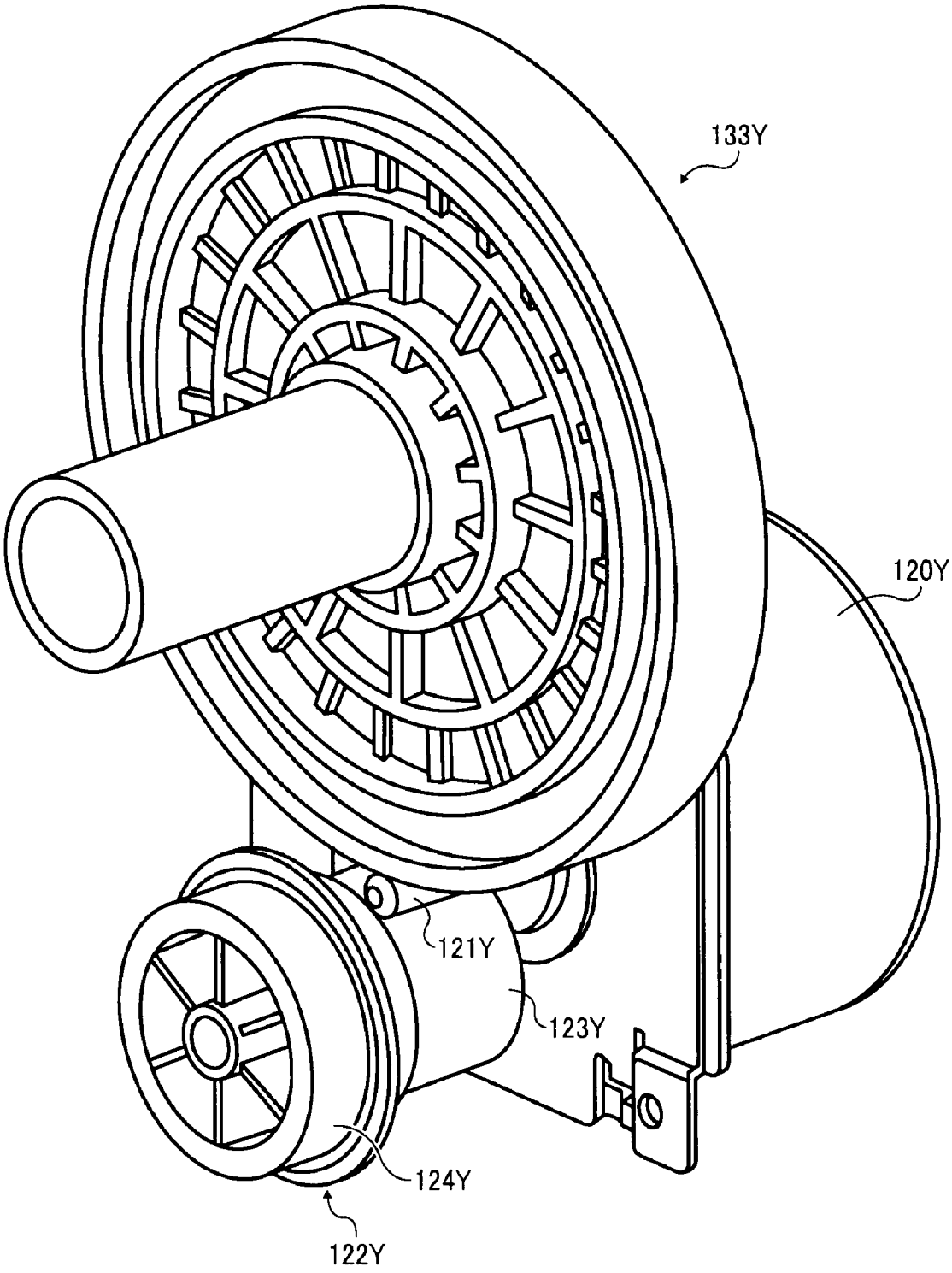
FIG. 8 is an enlarged perspective view illustrating a photoconductor gear and a configuration around the photoconductor gear included in the image forming apparatus.

FIG. 8 is an enlarged perspective view illustrating the photoconductor gear 133Y and a configuration around the photoconductor gear 133Y.

Referring to FIG. 8, the drive gear 121Y fixed to a motor shaft of the process drive motor 120Y is engaged with the photoconductor gear 133Y as well as the first gear 123Y of the developing gear 122Y. The photoconductor gear 133Y is rotatably supported by the drive transmission unit of the image forming apparatus 200. The diameter of the photoconductor gear 133Y is larger than that of the photoconductor 3Y. When the process drive motor 120Y is rotated, the driving force of the process drive motor 120Y is transmitted from the drive gear 121Y to the photoconductor gear 133Y with one-stage reduction to rotate the photoconductor 3Y. The process units 1C, 1M, and 1K have the same configuration as described above.

The rotational shaft of each of the photoconductors 3 is connected to each of the photoconductor gears 133 supported by the main body of the image forming apparatus 200 with a coupling.

A description is now given of how driving of the photoconductors 3 in the image forming apparatus 200 is controlled.

Figure 9:
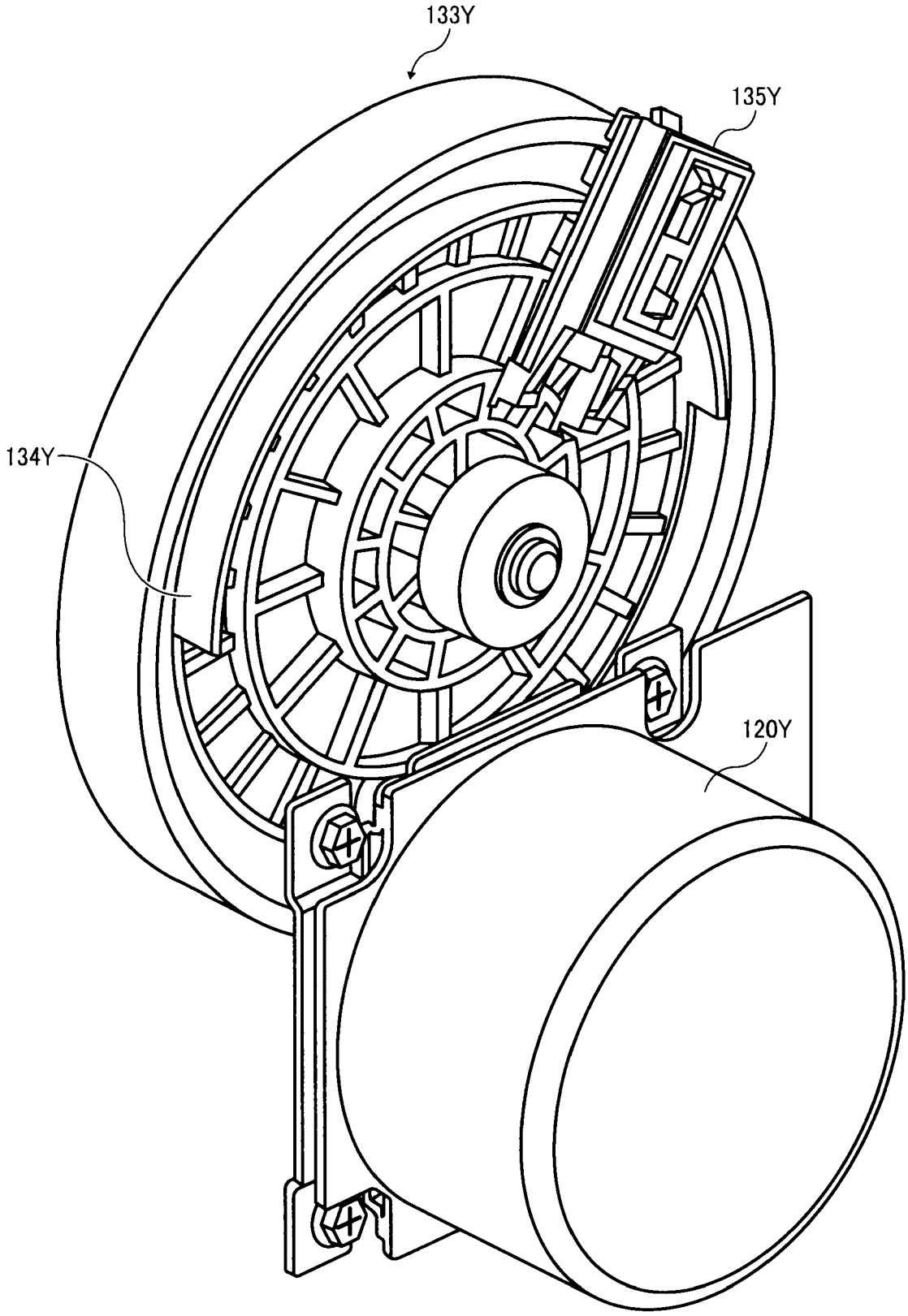
FIG. 9 is an enlarged perspective view illustrating the photoconductor gear and a configuration around the photoconductor gear viewed from a process drive motor side.

FIG. 9 is an enlarged perspective view illustrating the photoconductor gear 133Y and a configuration around the photoconductor gear 133Y viewed from the process drive motor 120Y side.

Referring to FIG. 9, a reference marker 134Y serving as a marking protrudes from a predetermined position on the photoconductor gear 133Y in a direction of rotation of the photoconductor gear 133Y. A position sensor 135Y serving as reference marker detection means is provided on a lateral side of the photoconductor gear 133Y. When the photoconductor gear 133Y is in a certain rotational position, the reference marker 134Y is positioned opposite the position sensor 135Y and is detected by the position sensor 135Y. As a result, each revolution of the photoconductor gear 133Y is detected by the position sensor 135Y when the photoconductor gear 133Y is at a predetermined rotational angle.

Figure 10:
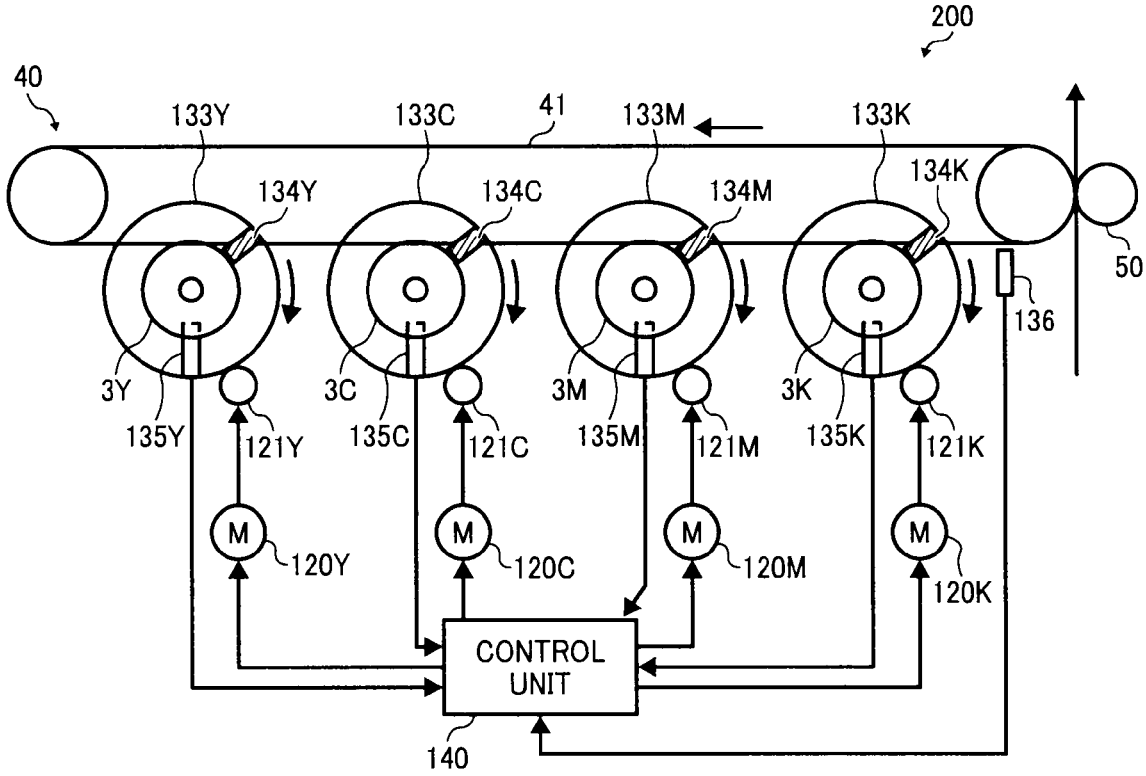
FIG. 10 is a schematic view illustrating a configuration of the image forming apparatus viewed from an axial direction of photoconductors.

FIG. 10 is a schematic view illustrating a configuration of the image forming apparatus 200 viewed from an axial direction of photoconductors 3.

Each of reference markers 134Y, 134C, 134M, and 134K (hereinafter collectively referred to as reference markers 134) provided to each of photoconductor gears 133Y, 133C, 133M, and 133K (hereinafter correctively referred to as photoconductor gears 133) rotated coaxially with the photoconductors 3 is detected each time each of the photoconductor gears 133 rotates one revolution by position sensors 135Y, 135C, 135M, and 135K (hereinafter collectively referred to as position sensors 135) each including a photosensor or the like.

In the transfer unit 40, an optical sensor unit 136 is provided opposite a portion of the intermediate transfer belt 41 stretched taut, separated by a certain distance therefrom. The optical sensor unit 136 includes two reflective photosensors, not shown, spaced a certain distance apart in a width direction of the intermediate transfer belt 41.

The control unit 140 controls the rotational speed of the process drive motors 120 and a time to start or stop rotation of the process drive motors 120. The control unit 140 performs process control of the image forming apparatus 200, and includes the CPU, the ROM, the RAM, and so forth as described above. Detection signals output from the position sensors 135 provided for detecting the rotational position of each of the photoconductors 3 are input to the control unit 140. The control unit 140 controls the process drive motors 120 based on the detection signals to control the rotational speed of the photoconductors 3.

The control unit 140 performs speed detection and control on the photoconductors 3 at predetermined times, in order to detect a pattern of variation in speed (hereinafter speed variation pattern) for each of the photoconductors 3 for each revolution caused by eccentricity of the photoconductor gears 133. Examples of such predetermined times include when an operation that changes the speed variation pattern is performed at replacement of the process units 1 and when print requests are received during a high-quality print mode.

Figure 11:
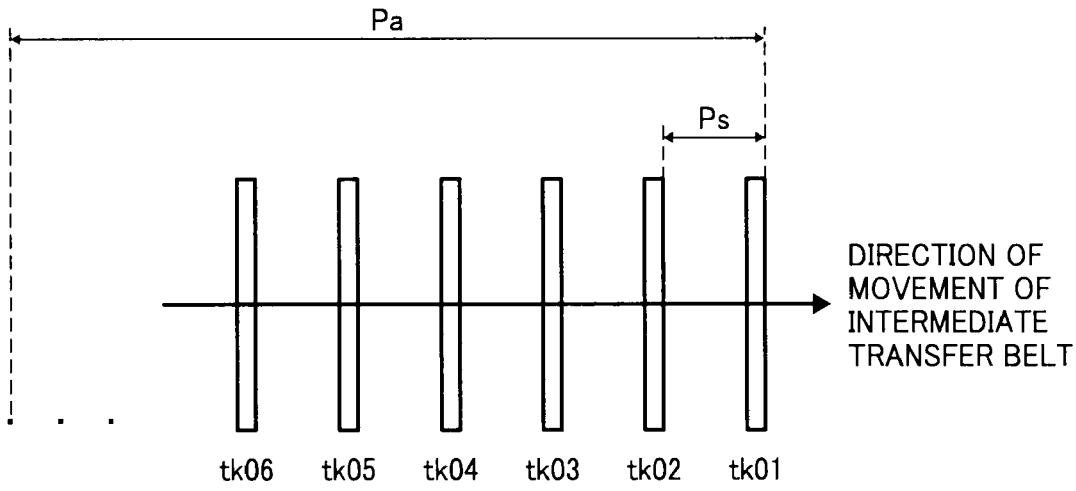
FIG. 11 is a view illustrating how to form images for speed variation detection using the image forming apparatus.

When speed detection and control are performed, formation of toner images for speed variation detection for each color is started based on the time when the reference markers 134 of the photoconductor gears 133 are detected by the position sensors 135. The toner images for speed variation detection formed on the photoconductors 3 are transferred onto the intermediate transfer belt 41 without being superimposed on one another. Taking formation of a black toner image for speed variation detection as an example, multiple toner images of black tk01, tk02, tk03, tk04, tk05, tk06, and so on are placed on the intermediate transfer belt 41 at a predetermined pitch along a direction of movement of the intermediate transfer belt 41, that is, a sub-scanning direction, as illustrated in FIG. 11. It is to be noted that pitch error may occur due to variation in the rotational speed of the photoconductor 3K.

The toner images for speed variation detection thus formed on the intermediate transfer belt 41 are conveyed to a position opposite the optical sensor unit 136 with the rotation of the intermediate transfer belt 41. When passing immediately below the optical sensor unit 136, each of the toner images is detected by the optical sensor unit 136. As a result, pitch errors are detected based on detection time of a pitch of each of the toner images. The pitch errors thus detected correspond to speed variation caused by eccentricity of the photoconductor gears 133.

The control unit 140 analyzes the speed variation pattern of each revolution of the photoconductor gears 133 based on the pitch errors thus detected and a frequency of one revolution of the photoconductor gears 133. An example of a method for analyzing the speed variation pattern as described above is analyzing an amplitude and a phase of a variation component from a zero cross or a peak value of a variation value. However, the above-described method is not practical because the detected data is considerably affected by noise, causing a large error. To solve such a problem, the image forming apparatus 200 employs a method for analyzing the speed variation pattern by performing quadrature detection. By performing quadrature detection, the speed variation pattern can be analyzed using a smaller number of pieces of variation data.

In the image forming apparatus 200, although there is a slight difference in amplitude between the speed variation pattern of the photoconductors 3 and that of the photoconductor gears 133, wave phases of the speed variation pattern of the photoconductors 3 and that of the photoconductor gears 133 are completely identical. Accordingly, detection of the speed variation pattern of the photoconductor gears 133 is same as detection of the speed variation pattern of the photoconductors 3.

Figure 12:
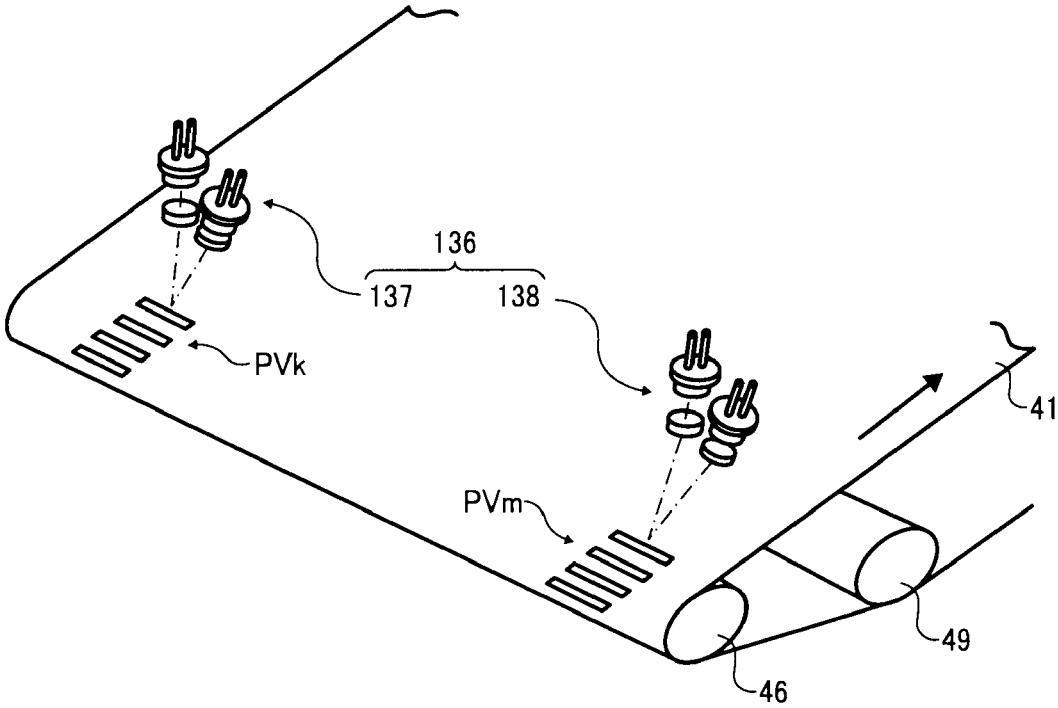
FIG. 12 is a perspective view illustrating a transfer unit and an optical sensor unit.

In order to reduce a time required for performing speed detection and control, a black toner image PVk for speed variation detection and a magenta toner image Pvm for speed variation detection are formed on the intermediate transfer belt 41 such that the black toner image PVk and the magenta toner image Pvm are arranged in a width direction of the intermediate transfer belt 41 as illustrated in FIG. 12. The black toner image PVk formed on one edge of the intermediate transfer belt 41 in the width direction thereof is detected by a first optical sensor 137 of the optical sensor unit 136. The magenta toner image PVm formed on the other edge of the intermediate transfer belt 41 in the width direction thereof is detected by a second optical sensor 138 of the optical sensor unit 136. As a result, a pitch error for the black toner image PVk and that for the magenta toner image PVm can be detected at the same time, reducing the time required for performing speed detection and control. Pitch error for each of the yellow and cyan toner images for the speed variation detection are also similarly simultaneously detected.

Figure 13:
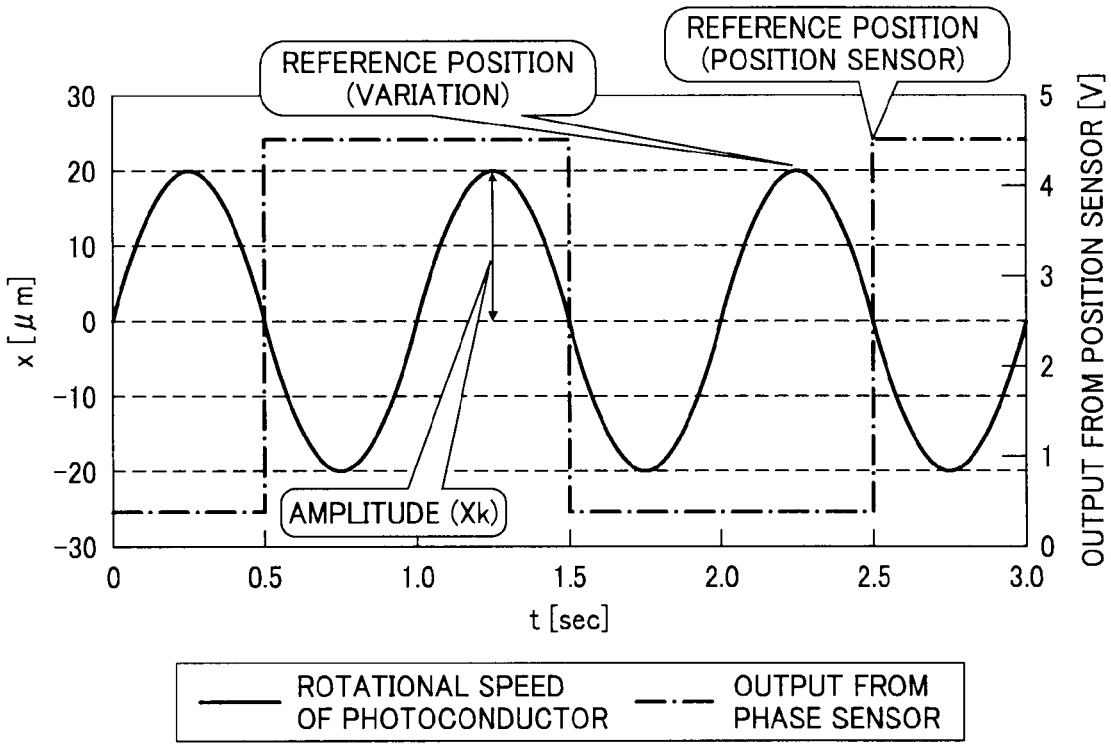
FIG. 13 is a graph illustrating a speed variation pattern of a photoconductor.

When the control unit 140 detects the speed variation pattern of the photoconductors 3 for each revolution by performing speed detection and control as described above, a variation characteristic having a sine-wave pattern is obtained for each frequency for each revolution of the photoconductors 3 as illustrated in FIG. 13.

Figure 14:
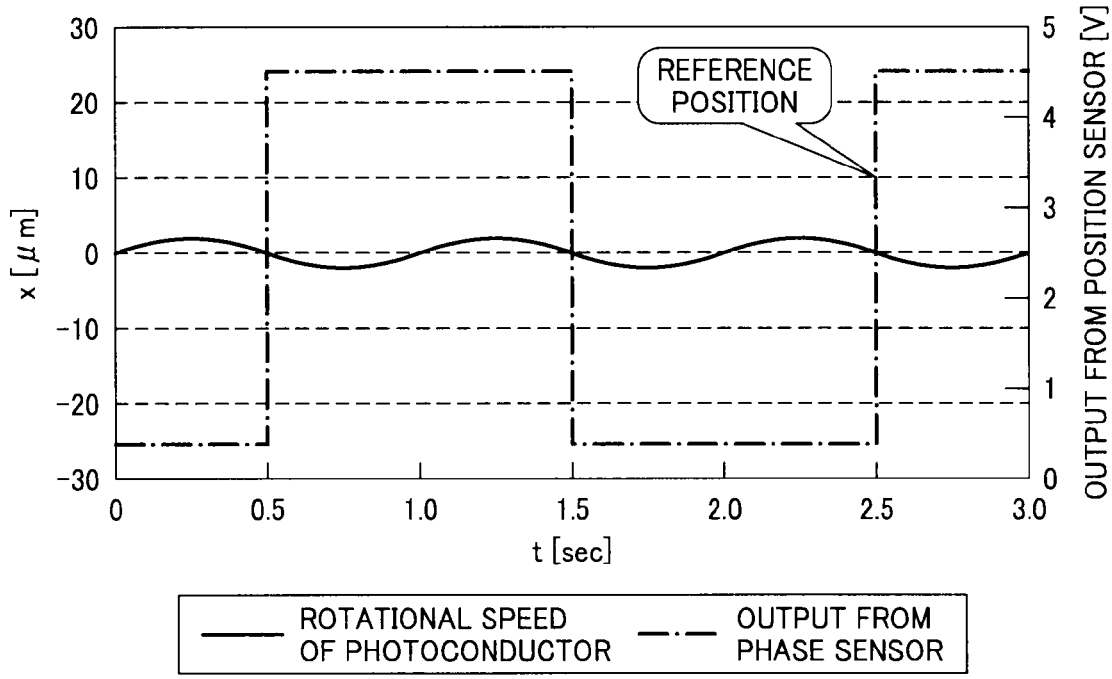
FIG. 14 is a graph illustrating a speed variation pattern of the photoconductor after control.

The control unit 140 varies a clock frequency applied to the process drive motors 120 such that the driving speed pattern has a phase opposite to that of the variation characteristic. As a result, speed variation of the photoconductors 3 caused by eccentricity can be substantially eliminated by varying the rotational speed of the photoconductor gears 133 as illustrated in FIG. 14.

Ordinarily, driving speed of the process drive motors 120 is controlled for canceling the variation characteristic at start of wave phases of the speed variation pattern when a leading edge of the image for speed variation detection is formed, that is, when the reference markers 134 of the photoconductor gears 133 are detected by the position sensors 135. Consequently, the speed variation of the photoconductors 3 is canceled when the position sensors 135 detect the reference markers 134 while the driving speed of the process drive motors 120 reaches the target speed after the process drive motors 120 start driving in response to the request to start printing. In a case of using the reference markers 134 as illustrated in FIG. 9, control to cancel the speed variation of the photoconductors 3 can be started when the position sensors 135 no longer detect the reference markers 134 as well as when the position sensors 135 detect the reference markers 134. In such a case, however, control to cancel the speed variation of the photoconductors 3 cannot be started until the photoconductors 3 are rotated at least a half-revolution. Consequently, the time to start formation of the latent images is delayed, causing a longer time for the first series of the printing operations.

By contrast, according to illustrative embodiments, the rotational position of the photoconductors 3 is obtained when the rotational speed of the photoconductors 3 reaches the target speed. As a result, control to cancel the speed variation of the photoconductors 3 can be started before the position sensors 135 detect the reference markers 134 and after the rotational speed of the photoconductors 3 reaches the target speed.

Specifically, the rotational position of the photoconductors 3 immediately after the rotational speed of the photoconductors 3 reaches the target speed is obtained based on the rotational position of the photoconductors 3 when driving of the process drive motors 120 is stopped. Because driving of the process drive motors 120 is stopped when the reference markers 134 are detected by the position sensors 135 according to illustrative embodiments, the rotational position of the photoconductors 3 when driving of the process drive motors 120 is stopped can be easily obtained.

Figure 15:
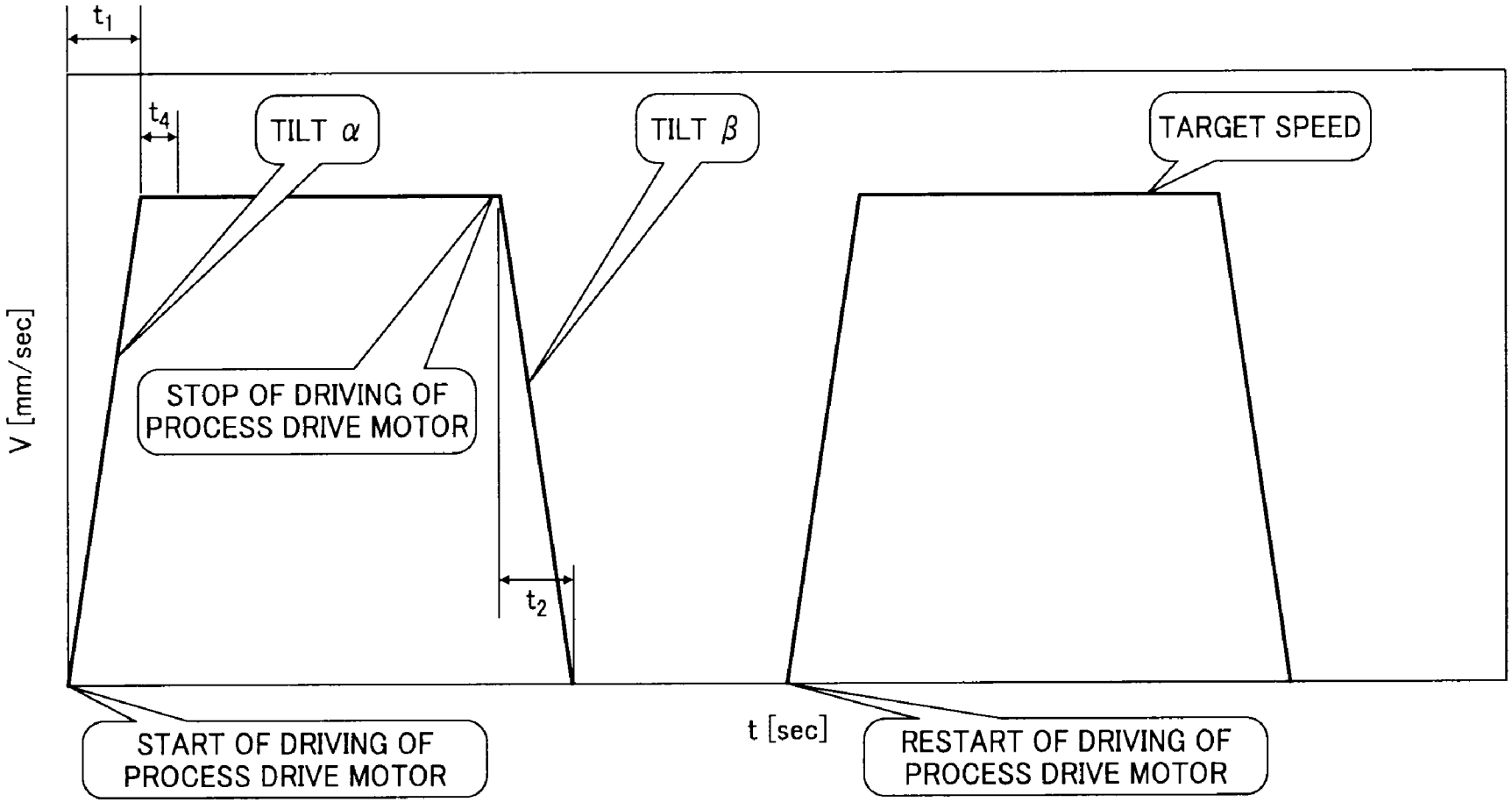
FIG. 15 is a graph illustrating a relation between a rotational speed of the process drive motor and time.

FIG. 15 is a graph illustrating a relation between the driving speed of the process drive motors 120 and time. As illustrated in FIG. 15, the driving speed of the process drive motors 120 reaches the target speed t1 seconds after the process drive motors 120 start driving. Even when driving of the process drive motors 120 is stopped, the process drive motors 120 are kept rotated due to an inertial force from the photoconductors 3. Therefore, rotation of the process drive motors 120 is stopped t2 seconds later from when driving of the process drive motors 120 is stopped. In other words, the photoconductors 3 are kept rotated after driving of the process drive motors 120 is stopped, and until rotational speed of the process drive motors 120 reaches the target speed. Therefore, in order to obtain the rotational position of the photoconductors 3 immediately after the rotational speed of the photoconductors 3 reaches the target speed, it is required to obtain a rotational angle of the photoconductors 3 during the time from when driving of the process drive motors 120 is stopped to when rotation of the photoconductors 3 is stopped, and during the time from when driving of the process drive motors 120 is started to when the rotational speed of the photoconductors 3 reaches the target speed.

According to illustrative embodiments, rotational angle data for obtaining the rotational angle of the photoconductors 3 during the time from when driving of the process drive motors 120 is stopped to when driving of the process drive motors 120 is restarted and the rotational speed of the photoconductors 3 reaches the target speed is obtained by experiment as described in detail below.

In the experiment, first, the process drive motors 120 are rotated at a speed for speed detection and control (hereinafter referred to as detection target speed). The process drive motors 120 stop driving when the reference markers 134 are detected by the position sensors 135 to stop rotation of the photoconductors 3. When the photoconductors 3 stop rotating, driving of the process drive motors 120 is restarted, and a time t3 from when the rotational speed of the photoconductors 3 reaches the target speed to when the reference markers 134 are detected by the position sensors 135 is measured.

The rotational position of the photoconductors 3 immediately after the rotational speed of the photoconductors 3 reaches the predetermined speed can be calculated based on the rotational position of the photoconductors 3 when the process drive motors 120 stop driving using the time t3 thus obtained and the speed variation of the photoconductors 3.

A detailed description is now given of how to calculate the rotational position described above with reference to FIGS. 16A and 16B.

Figure 16A:
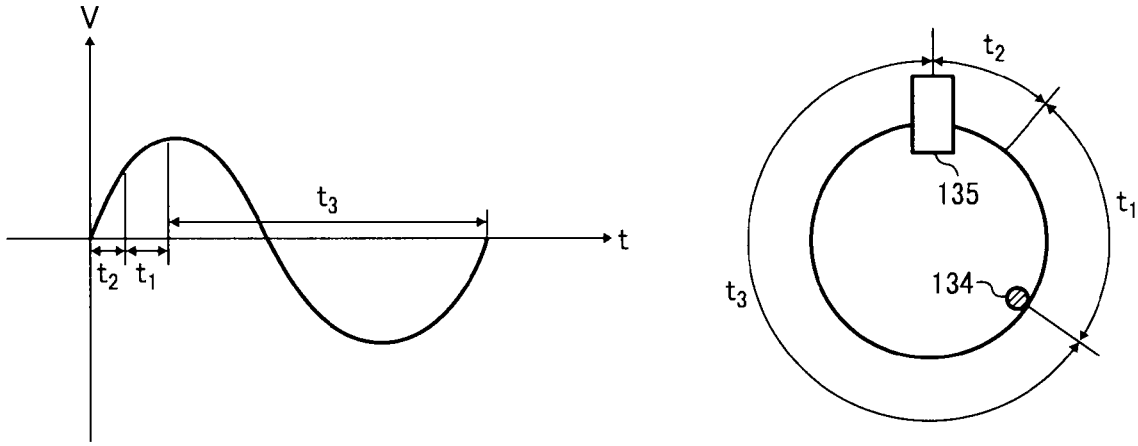
FIGS. 16A and 16B are views illustrating a change in a rotational position of the photoconductor immediately after a rotational speed of the photoconductor reaches a predetermined speed depending on the speed variation pattern of the photoconductor.
Figure 16B:
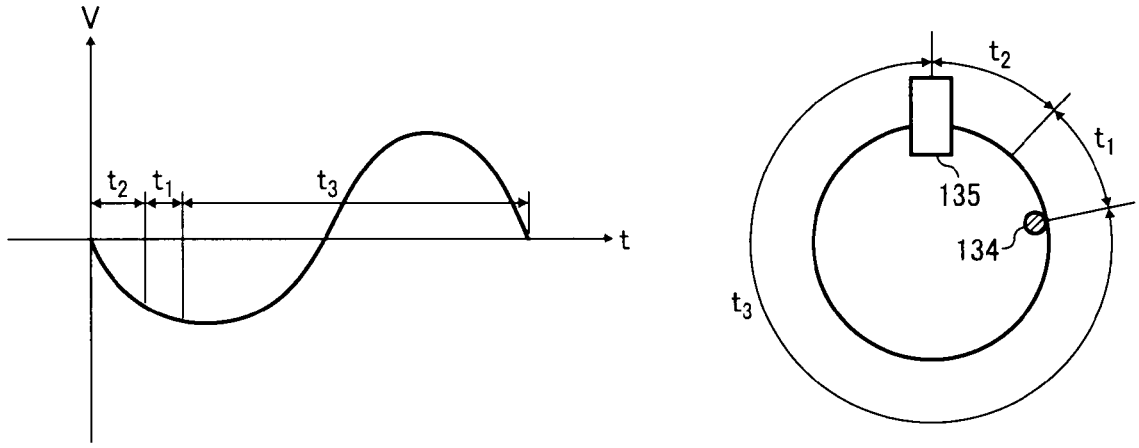

FIGS. 16A and 16B are views illustrating a change in the rotational position of the photoconductors 3 immediately after the rotational speed of the photoconductors 3 reaches the predetermined speed depending on the speed variation pattern of the photoconductors 3.

The time t2 from when driving of the process drive motors 120 is stopped to when rotation of the photoconductors 3 is stopped, and the time t1 from when the process drive motors 120 start driving to when the rotational speed of the photoconductors 3 reaches the target speed are kept constant without affecting data on the angle for controlling amplitude. As illustrated in FIGS. 16A and 16B, the rotational position of the photoconductors 3, that is, the position of the reference markers 134, varies depending on the speed variation pattern of the photoconductors 3. However, a sum of t1 and t2 is not always smaller than 3 revolutions of the photoconductors 3, but varies depending on characteristics of the process drive motors 120 and a configuration of a transmission mechanism for transmitting the driving force of the process drive motors 120 to the photoconductors 3.

The times t1 and t2 are used as the rotational angle data so that the rotational angle of the photoconductors 3 during the time when the process drive motors 120 stop driving to when the process drive motors 120 restart driving and the rotational speed of the photoconductors 3 reaches the target speed can be obtained from the speed variation pattern of the photoconductors 3. However, it is required to calculate the rotational angle taking into consideration speed reduction of the photoconductors 3 when rotation thereof is stopped and speed increase when rotation thereof is started, causing large burden on calculation.

To solve such a problem, the time t3 from when the rotational speed of the photoconductors 3 reaches the target speed to when the reference markers 134 are detected by the position sensors 135 is used. The time t3 is kept constant without affecting data on the angle for controlling amplitude, and is identical to the time required to detect the reference markers 134 using the position sensor 135 when the photoconductors 3 is rotated at a constant rotational speed identical to the rotational speed for the speed detection and control. Accordingly, the rotational angle of the photoconductors 3 during the time from when the process drive motors 120 stop driving to when the rotational speed of the photoconductors 3 reaches the target speed again can be estimated from the time t3 without correcting the speed variation pattern of the photoconductors 3 thus detected.

The rotational position of the photoconductors 3 immediately after the rotational speed of the photoconductors 3 reaches the target speed can be estimated from the rotational angle of the photoconductors 3 during the time from when the process drive motors 120 stop driving to when the rotational speed of the photoconductors 3 reaches the target speed again calculated using the time t3 serving as the rotational angle data and the speed variation pattern of the photoconductors 3, and the data on the rotational position of the photoconductors 3 when the process drive motors 120 stop driving.

The time to stop driving of the process drive motors 120 is arbitrarily set. In such a case, a time t5 from when the reference markers 134 are detected by the position sensors 135 to when driving of the process drive motors 120 is stopped is calculated. The rotational position of the photoconductors 3 when the process drive motors 120 stop driving is calculated from a ratio between the time t5 and a time required for the photoconductors 3 to rotate one revolution.

In the image forming apparatus 200 according to illustrative embodiments, the time t3 including the rotational angle data obtained by the above-described experiment is stored in the memory. When the speed variation pattern for each revolution of the photoconductors 3 is detected by performing speed detection and control, the rotational position of the photoconductors 3 immediately after the rotational speed of the photoconductors 3 reaches the target speed is calculated based on the speed variation pattern thus detected and the time t3, and stored in the memory. When the first series of printing operations is performed, the control unit 140 reads out the rotational position of the photoconductors 3 stored in the memory, and recognizes a clock frequency to be applied to the process drive motors 120 to cancel the speed variation of the photoconductors 3 immediately after the rotational speed of the photoconductors 3 reaches the target speed based on the data on the rotational position of the photoconductors 3 thus read out and the speed variation pattern. Thereafter, the control unit 140 starts control to cancel the speed variation of the photoconductors 3 immediately after the rotational speed of the photoconductors 3 reaches the target speed and before the position sensors 135 detect the reference markers 134.

There may be a slight difference between the rotational position of the photoconductors 3 thus calculated and an actual rotational position of the photoconductors 3 immediately after the rotational speed of the photoconductors 3 reaches the target speed. Accordingly, when the reference markers 134, which are reference positions of the speed variation pattern, are detected by the position sensors 135, control based on the rotational position of the photoconductors 3 calculated as described above may be switched to control based on the rotational position of the photoconductors 3 obtained by detecting the reference markers 134 using the position sensors 135.

Figure 17:
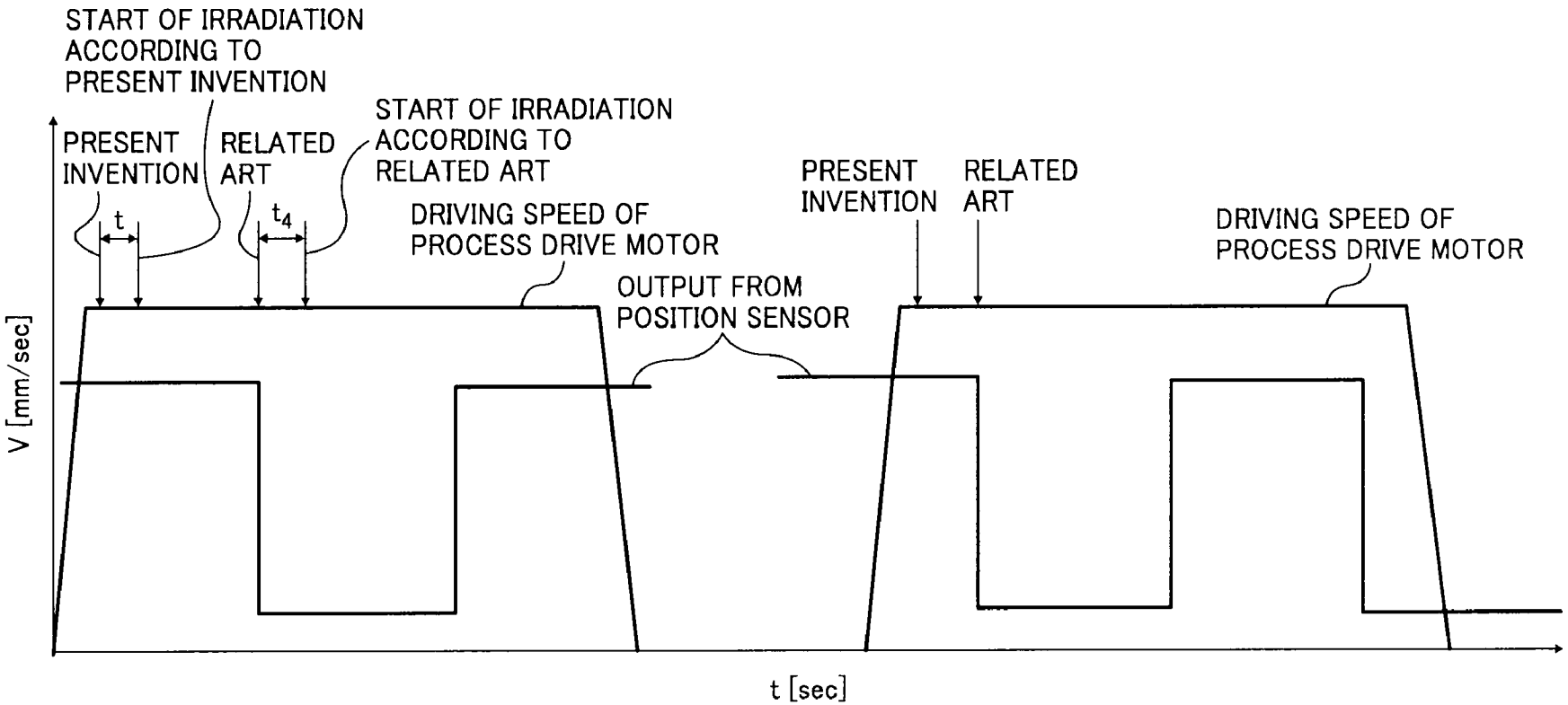
FIG. 17 is a graph illustrating a difference in a time to start control for canceling a speed variation of the photoconductor between a related-art image forming apparatus and the image forming apparatus according to illustrative embodiments.

FIG. 17 is a graph illustrating a difference in a time to start control for canceling the speed variation of the photoconductors 3 between the related art and illustrative embodiments of the present invention.

As illustrated in FIG. 17, the rotational position of the photoconductors 3 immediately after the rotational speed of the photoconductors 3 reaches the target speed can be recognized by the image forming apparatus 200 according to illustrative embodiments. Accordingly, control can be started immediately after the rotational speed of the process drive motors 120 reaches the target speed. As a result, in the image forming apparatus 200 according to illustrative embodiments, start of the control can be accelerated compared to the related-art image forming apparatus in which control is started after the position sensor detects the reference marker. Therefore, formation of the latent images started the t4 seconds later than the start of control can be accelerated compared with the related-art image forming apparatus, resulting in faster print time for the first series of the printing operation. It is to be noted that, alternatively, formation of the latent images may be started immediately after the start of control, that is, the t4 is zero.

A description is now given of shutdown and startup sequences according to illustrative embodiments.

In general, it is determined whether or not to move to the shutdown sequence at a predetermined time (hereinafter referred to as shutdown determination time) after completion of image formation. According to illustrative embodiments, different shutdown determination times are used during a monochrome mode for forming monochrome images and a full-color mode for forming full-color images.

Specifically, in the monochrome mode, completion of intermediate transfer of the black toner image, that is, completion of intermediate transfer of the rear edge of the black toner image formed on the photoconductor 3K onto the intermediate transfer belt 41, is set as the shutdown determination time. By contrast, in the full-color mode, completion of secondary transfer, that is, when the rear edge of the full-color toner image formed on the intermediate transfer belt 41 is transferred onto the recording sheet P, is set as the shutdown determination time.

It is to be noted that, alternatively, another appropriate time may be set as the shutdown determination time. According to illustrative embodiments, process control may be performed after completion of image formation in accordance with predetermined requirements. In such a case, the determination whether or not to move to the shutdown sequence is performed after completion of process control, and that time is set as the shutdown determination time.

The control unit 140 determines whether or not to move to the shutdown sequence based on whether or not a request for subsequent image formation, that is, a subsequent print request, is present at the shutdown determination time. Specifically, when the subsequent print request is present at the shutdown determination time, the control unit 140 determines not to move to the shutdown sequence. By contrast, when the subsequent print request is not present at the shutdown determination time, the control unit 140 determines to move to the shutdown sequence. It is to be noted that, in addition to presence of the subsequent print request, other requirements, such as occurrence of errors, may be used to determine whether or not to move to the shutdown sequence.

Figure 18:
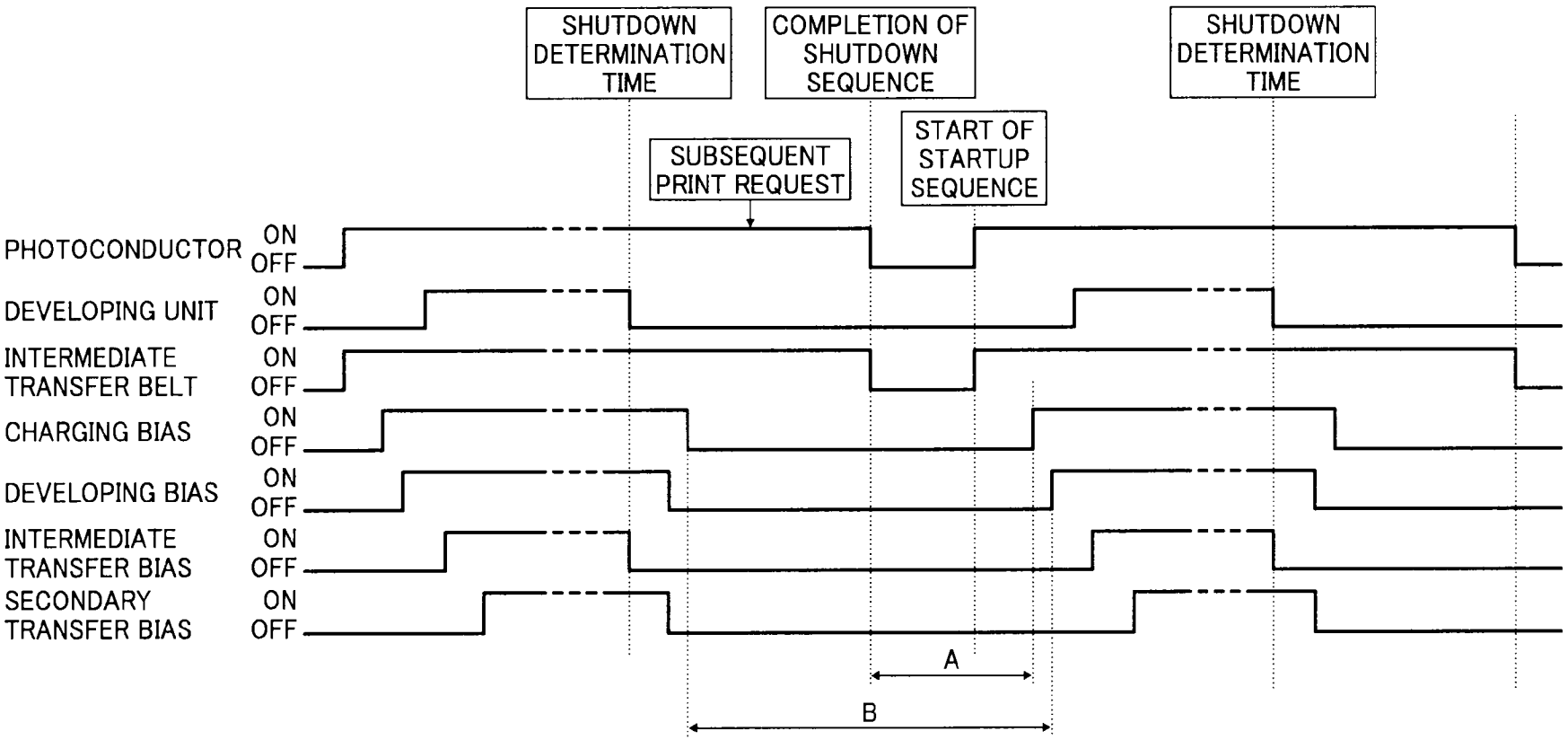
FIG. 18 RELATED ART
FIG. 18 is a timing chart illustrating a shutdown sequence during a monochrome mode in the related-art image forming apparatus.
Figure 19:
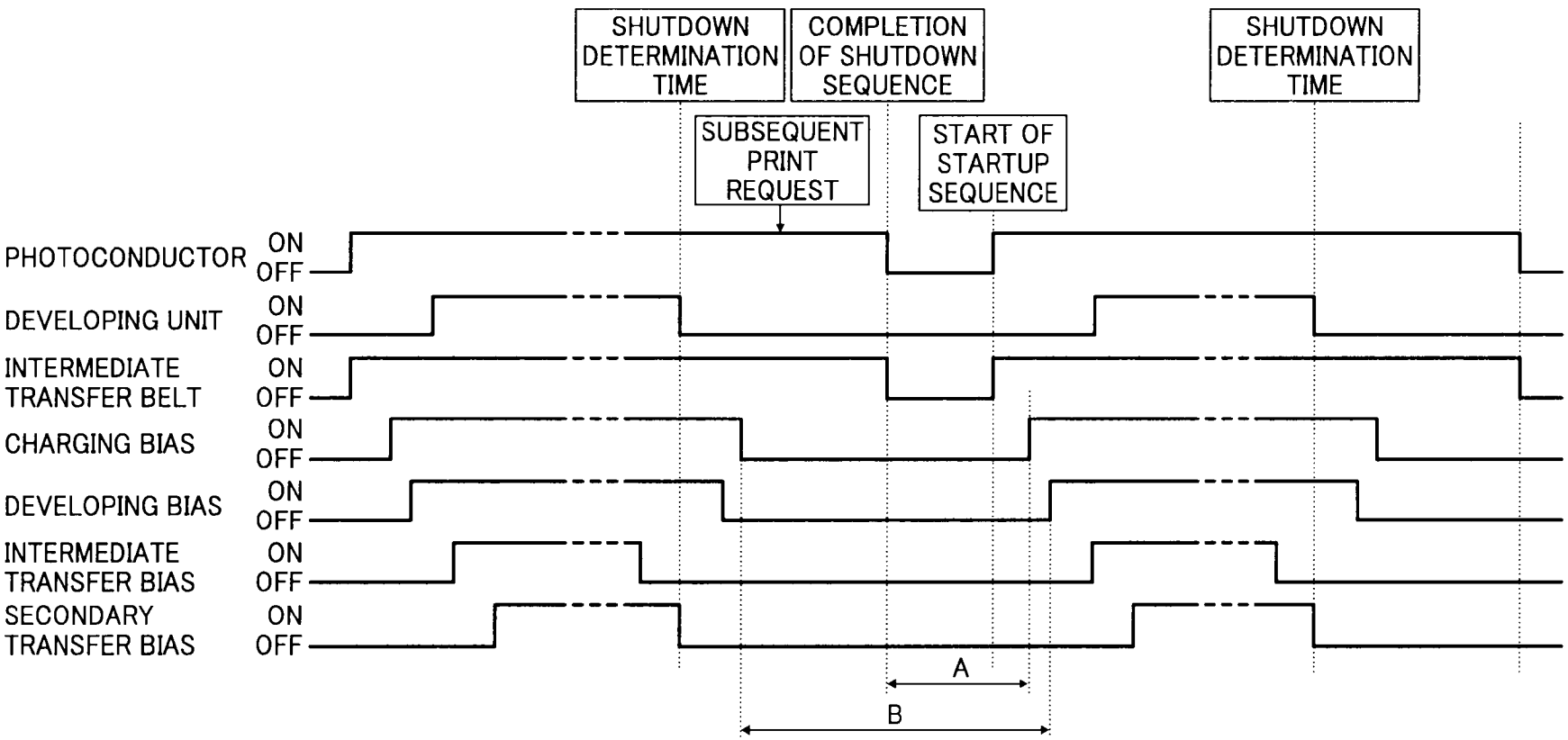
FIG. 19 RELATED ART
FIG. 19 is a timing chart illustrating a shutdown sequence during a full-color mode in the related-art image forming apparatus.
Figure 20:
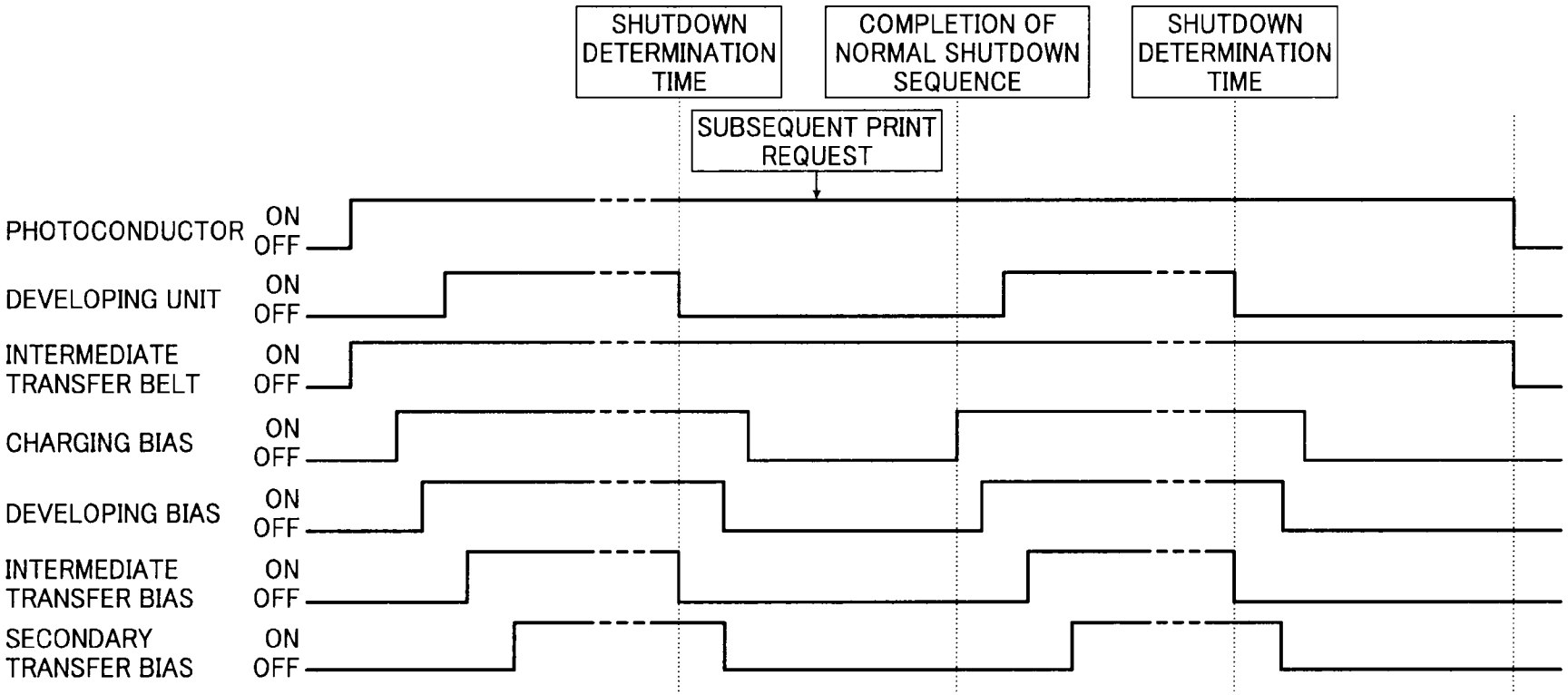
FIG. 20 is a timing chart illustrating an example of a shutdown sequence during a monochrome mode in the image forming apparatus according to illustrative embodiments.
Figure 21:
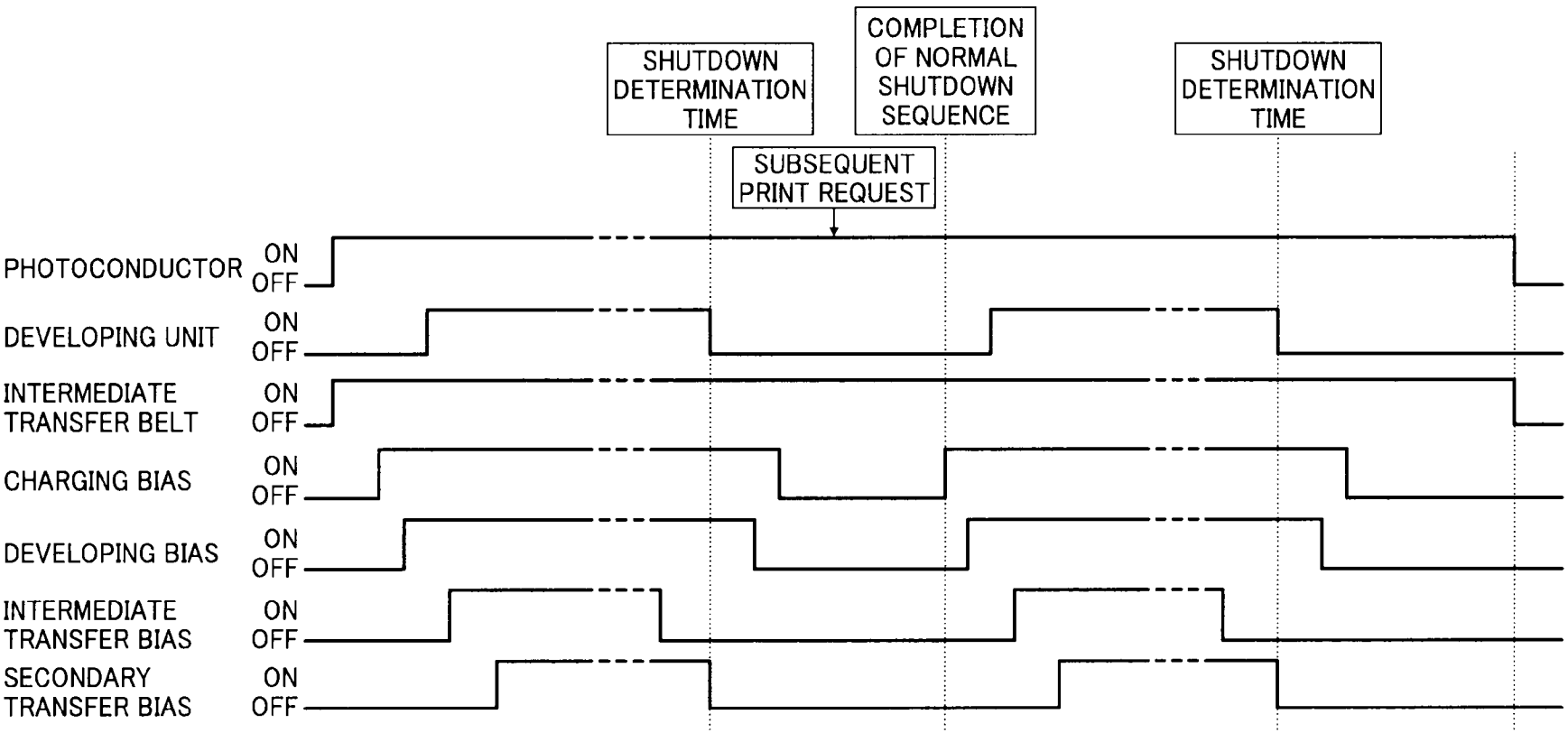
FIG. 21 is a timing chart illustrating an example of a shutdown sequence during a full-color mode in the image forming apparatus according to illustrative embodiments.

FIG. 18 is a timing chart illustrating the shutdown sequence during the monochrome mode according to the related-art image forming apparatus. FIG. 19 is a timing chart illustrating the shutdown sequence during the full-color mode according to the related-art image forming apparatus. FIG. 20 is a timing chart illustrating an example of the shutdown sequence during the monochrome mode in the image forming apparatus 200. FIG. 21 is a timing chart illustrating an example of the shutdown sequence during the full-color mode in the image forming apparatus 200.

It is to be noted that FIGS. 18-21 show only main timings for shutdown control such as driving of the photoconductors 3 (movement of the surface of the latent image bearing member), driving of the developing units 7 (movement of the surface of the developer bearing member and rotation of the agitation conveyance member), driving of the intermediate transfer belt 41 (movement of the surface of the intermediate transfer body), and application of the charging bias, the developing bias, the intermediate transfer bias (primary transfer bias), and the secondary transfer bias. Other timings are omitted.

During the monochrome mode, when the control unit 140 determines to move to the shutdown sequence at completion of intermediate transfer, the image forming apparatus 200 enters the shutdown sequence. At this time, the photoconductors 3Y, 3C, and 3M are removed from the intermediate transfer belt 41 as described above, and image formation is performed without driving the process units 1Y, 1C, and 1M. Accordingly, a process to stop driving of the process units 1Y, 1C, and 1M does not need to be performed during the monochrome mode.

In the shutdown sequence during the monochrome mode, first, driving of the developing unit 7K is stopped in order to reduce stress on the developer caused by agitation performed by the first conveyance screw 8K and the second conveyance screw 11K. In addition, according to illustrative embodiments, application of the intermediate transfer bias to the primary transfer roller 45K is also stopped at the same time as driving of the developing unit 7K is stopped. Accordingly, an extremely small amount of toner particles remaining on the surface of the photoconductor 3K passing through the intermediate transfer area tends not to be attached to the intermediate transfer belt 41.

Thereafter, application of the secondary transfer bias to the secondary transfer roller 50 is stopped at completion of secondary transfer of the black toner image. As a result, an extremely small amount of toner particles remaining on the surface of the intermediate transfer belt 41 passing through the secondary transfer area tends not to be attached to the secondary transfer roller 50.

Further, according to illustrative embodiments, application of the developing bias applied to the developing roller 12K is also stopped substantially at the same time as application of the secondary transfer bias is stopped. Thereafter, application of the charging bias is stopped. It is preferable to stop application of the developing bias before a portion of the surface of the photoconductor 3K, of which potential is decreased by stopping application of the charging bias, reaches the developing area. The reason is that when the developing bias is applied to such a portion in the developing area, the toner included in the developer remaining on the surface of the developing roller 12K tends to attach to the photoconductor 3K.

However, in a case in which application of the developing bias is stopped when a portion of the surface of the photoconductor 3K, of which potential is kept higher due to application of the charging bias, reaches the developing area, the carriers included in the developer remaining on the surface of the developing roller 12K tend to attach to the photoconductor 3K. Accordingly, it is preferable to stop application of the charging bias first, and then stop application of the developing bias when a leading edge of the portion of the surface of the photoconductor 3K of which potential is decreased reaches the developing area. As a result, both the toner and the carrier included in the developer remaining on the surface of the developing roller 12K can be prevented from attaching to the photoconductor 3K.

Finally, driving of the photoconductor 3K and the intermediate transfer belt 41 is stopped. According to illustrative embodiments, the photoconductor 3K and the intermediate transfer belt 41 always contact each other. Therefore, driving of the photoconductor 3K and the intermediate transfer belt 41 needs to be stopped or started up at the same time without a time difference.

During the full-color mode, when the control unit 140 determines to move to the shutdown sequence at completion of secondary transfer, the image forming apparatus 200 enters the shutdown sequence. In the shutdown sequence during the full-color mode, driving of the developing units 7 in the process units 1 is stopped first in the same manner as the case of the monochrome mode. According to illustrative embodiments, application of the secondary transfer bias applied to the secondary transfer roller 50 is stopped substantially at the same time as driving of the developing units 7 is stopped. Accordingly, an extremely small amount of the toner remaining of the surface of the intermediate transfer belt 41 passing through the secondary transfer area tends not to be attached to the secondary transfer roller 50. It is to be noted that, because application of the intermediate transfer bias is already stopped at completion of secondary transfer, the process to stop application of the intermediate transfer bias is not performed during the full-color mode.

Thereafter, application of the developing bias applied to the developing rollers 12 in the developing units 7 is stopped, and then application of the charging bias is stopped. Similarly to the case of the monochrome mode, it is preferable to stop application of the developing bias before the portions of the surface of the photoconductors 3 of which potential is decreased by stopping application of the charging bias reaches the respective developing areas. It is more preferable that application of the charging bias is stopped first, and then application of the developing bias is stopped when the leading edge of such portion of the surface of the photoconductors 3 reaches the respective developing areas.

Finally, driving of the photoconductors 3 and the intermediate transfer belt 41 is stopped. It is to be noted that in a case in which stopping positions of the photoconductors 3 are adjusted in order to prevent occurrence of color shift in subsequent image formation, the photoconductors 3 are driven again after being shut down to be finely adjusted, and then driving of the photoconductors 3 is stopped again.

A description is now given of the startup sequence. When the print request is received, first, a process to start driving of the photoconductors 3 and the intermediate transfer belt 41 is performed. Subsequently, application of the charging bias is started, and application of the developing bias is started when the leading edge of the portion of the surface of the photoconductors 3 of which potential is increased by application of the charging bias reaches the developing area while keeping driving of the developing units 7 stopped, such that the toner and the carrier are prevented from being attached to the photoconductors 3. Because it is difficult to coincide the timing, a smaller amount of the toner may be attached to the surface of the photoconductors 3 due to a difference in the timing between when the leading edge of the surface of the photoconductors 3 supplied with the charging bias reaches the developing area and when application of the developing bias is started. In order to prevent the toner attached to the surface of the photoconductors 3 from being transferred onto the intermediate transfer belt 41, application of the intermediate transfer bias is started after the leading edge of the surface of the photoconductors 3 supplied with the charging bias reaches the intermediate transfer area and before the leading edge of the toner image formed on the photoconductors 3 reach the intermediate transfer area. Further, it is preferable to start application of the secondary transfer bias after the leading edge of the surface of the intermediate transfer belt 41 supplied with the charging bias reaches the secondary transfer area and before the leading edge of the toner image formed on the intermediate transfer belt 41 reaches the secondary transfer area.

In the startup sequence, in order to reduce stress on the developer caused by agitation performed by the first conveyance screw 8K and the second conveyance screw 11K, driving of the developing units 7 is started immediately before the leading edge of the latent image formed on the photoconductors 3 reaches the developing area.

During the full-color mode, a process to contact the intermediate transfer belt 41 against the photoconductors 3Y, 3C, and 3M may be performed. In such a case, the intermediate transfer belt 41 is contacted against the photoconductors 3Y, 3C, and 3M after the leading edge of the portion of the surface of the photoconductors 3 supplied with the charging bias reaches the intermediate transfer area and before the leading edge of the toner images formed on the photoconductors 3 reaches the intermediate transfer area.

By contrast, in the related-art image forming apparatus, when the subsequent print request is received during the shutdown sequence, the shutdown sequence is not suspended but is continued. Thereafter, when the image forming apparatus enters the startup sequence to be ready for image formation after completion of the shutdown sequence, image formation is started in accordance with the print request. Consequently, in such a case, the subsequent printing operation is not started until the rest of the shutdown sequence and the startup sequence after completion of the shutdown sequence are completed. As a result, the start of image formation in accordance with the print request is delayed, resulting in longer downtime and thus lowering productivity.

According to illustrative embodiments, in a case in which the subsequent print request is not received during the shutdown sequence, the shutdown sequence is performed in the same manner as in the related-art image forming apparatus as described above. By contrast, different processes are performed in a case in which the subsequent print request is received during the shutdown sequence, that is, during the time from when it is determined that the subsequent image forming request is not present at the shutdown determination time to when driving of the photoconductors 3 and the intermediate transfer belt 41 is stopped.

Specifically, as illustrated in FIGS. 20 and 21, driving of the developing units 7 and application of the charging bias, the developing bias, the intermediate transfer bias and the secondary transfer bias are stopped in accordance with the normal shutdown sequence after the subsequent print request is received. However, the image forming apparatus 200 enters the startup sequence to start application of the charging bias without stopping driving of the photoconductors 3 and the intermediate transfer belt 41. The rest of the startup sequence is performed in the same manner as the normal startup sequence.

A period A in FIGS. 18 and 19 indicates a total amount of time from when the control unit 140 issues a request to stop driving of the photoconductors 3 and the intermediate transfer belt 41 at completion of the shutdown sequence to when driving of the photoconductors 3 and the intermediate transfer belt 41 is actually stopped, and the time from when the control unit 140 issues a request to start driving of the photoconductors 3 and the intermediate transfer belt 41 to when the rotational speed of the photoconductors 3 and the intermediate transfer belt 41 reaches the target speed, that is, the time required to be ready to start application of the charging bias in the startup sequence. By performing the above-described process according to illustrative embodiments, downtime is reduced by the period A.

In a case in which the stopping positions of the photoconductors 3 are finely adjusted after stop of driving of the photoconductors 3, the time required for such adjustment can be omitted. However, according to illustrative embodiments, the stopping positions of the photoconductors 3 are adjusted during the startup sequence in order to prevent color shift as described above without finely adjusting the stopping positions of the photoconductors 3 after stop of driving of the photoconductors 3.

According to illustrative embodiments, in a case in which the subsequent print request is received during the shutdown sequence, the operations except driving of the photoconductors 3 and the intermediate transfer belt 41 are shut down in the same manner as the normal shutdown sequence. Accordingly, control performed in a case in which the subsequent print request is received during the shutdown sequence can be simplified. As a result, a software configuration can be simplified, considerably reducing occurrence of malfunctions (bugs) generally caused by a too-complex software configuration.

Alternatively, in the case in which the subsequent print request is received during the shutdown sequence, the operations except driving of the photoconductors 3 and the intermediate transfer belt 41 can be shut down differently from the normal shutdown sequence.

For example, in a case in which the subsequent print request is received during the time from when the control unit 140 determines that the request for the subsequent image formation is not present at the shutdown determination time to when application of the developing bias is stopped, a process to stop application of the charging bias and the developing bias may not be performed. As a result, downtime can be further reduced.

Figure 22:
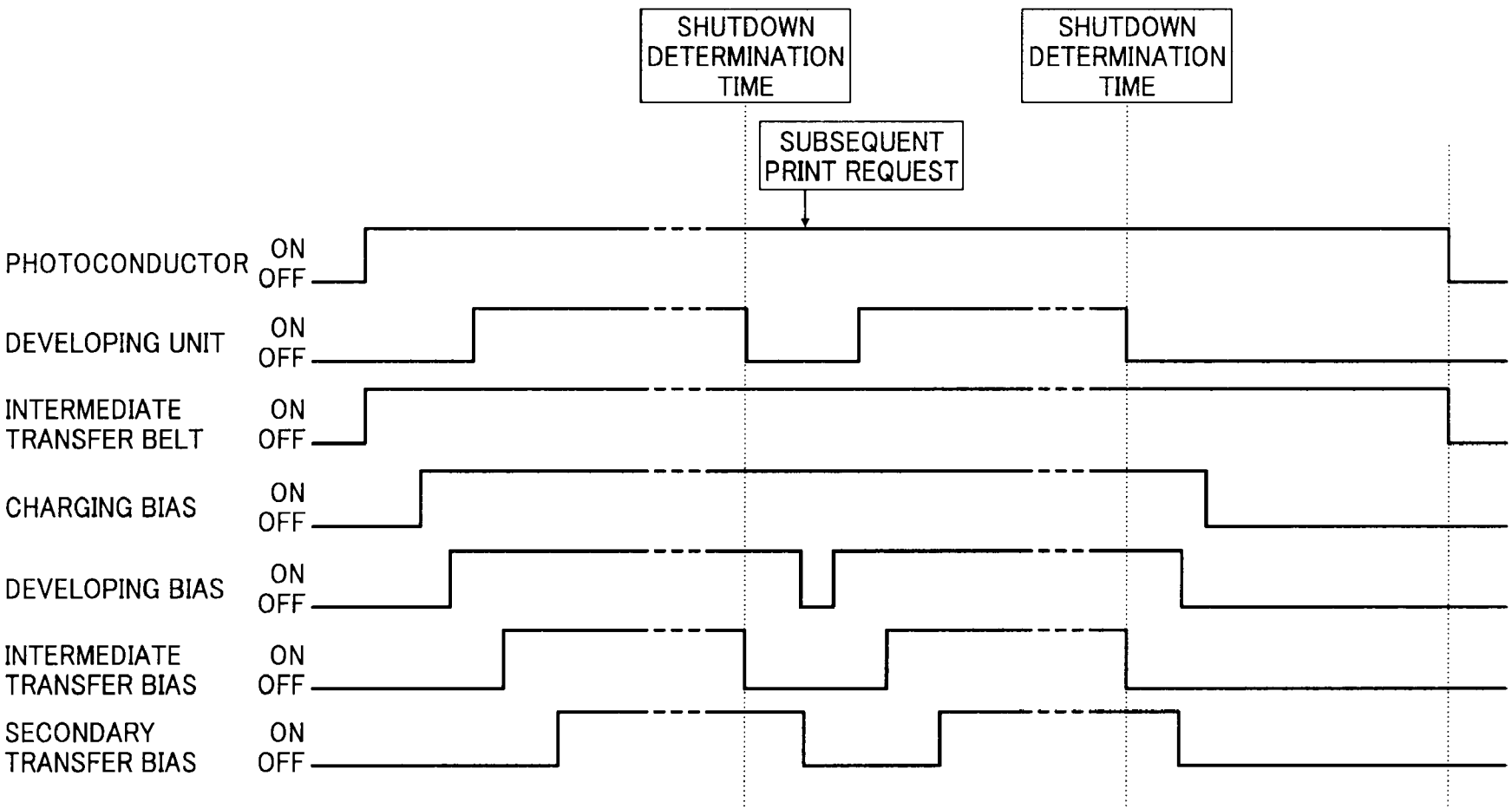
FIG. 22 is a timing chart illustrating another example of the shutdown sequence during the monochrome mode in the image forming apparatus according to illustrative embodiments.
Figure 23:
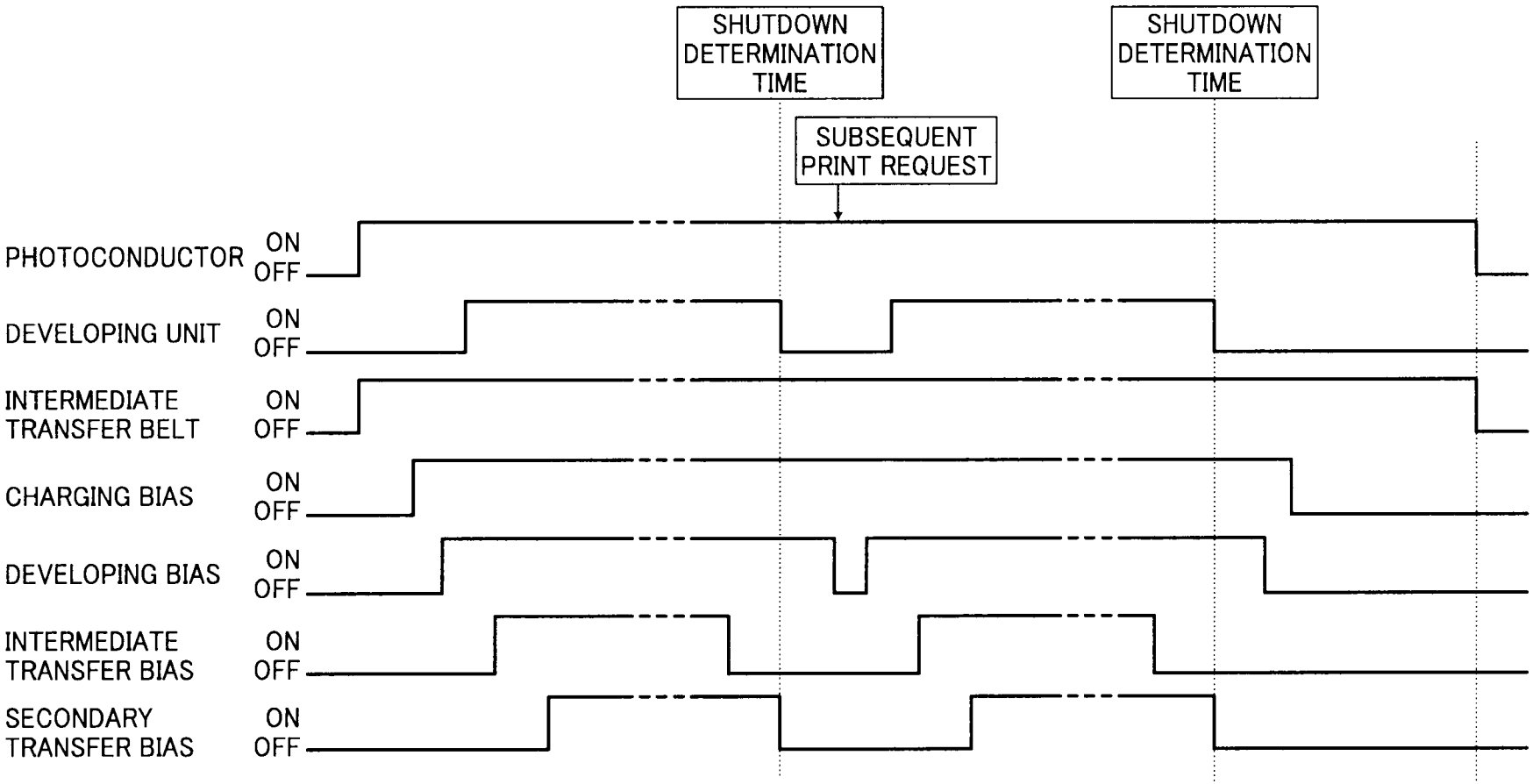
FIG. 23 is a timing chart illustrating another example of the shutdown sequence during the full-color mode in the image forming apparatus according to illustrative embodiments.

Further, in a case in which the subsequent print request is received during the time from when the process to stop application of the developing bias is started to when the process to stop application of the charging bias is started after the control unit 140 determines that the request for subsequent image formation is not present at the shutdown determination time, the process to stop application of the charging bias may not be performed. In such a case, as illustrated in FIGS. 22 and 23, neutralization of the photoconductors 3 is stopped immediately after receiving the subsequent print request, and the startup sequence is started to start application of the developing bias. The rest of the startup sequence is performed in the same manner as the normal startup sequence. At this time, driving of the developing units 7 are kept stopped such that the toner or the developer are prevented from being attached to the photoconductors 3, and application of the developing bias is started at the time when a portion of the photoconductor 3 where neutralization is stopped reaches the developing area. Accordingly, downtime can be reduced by a period B illustrated in FIGS. 18 and 19. Specifically, the period B corresponds to the time from when the control unit 140 issues a request to start the process to stop application of the charging bias during the normal shutdown sequence to when the control unit 140 issues a request to start application of the developing bias during the normal startup sequence.

As described above, in the image forming apparatus 200 according to illustrative embodiments, the surfaces of the photoconductors 3 are moved, and then evenly charged by the chargers 5 to form latent images thereon using the optical writing unit 20. Thereafter, toner is applied to the latent images thus formed using the developing units 7 to form toner images on the surface of the photoconductors 3. The toner images thus formed on the surface of the photoconductors 3 are temporarily transferred onto the intermediate transfer belt 41, and then further transferred onto the recording sheet P so that a full-color image is formed on the recording sheet P. When determining that a request for subsequent image formation, that is, the subsequent print request, is present at the shutdown determination time after completion of previous image formation, the image forming apparatus 200 controls such that subsequent image formation is performed in accordance with the subsequent print request. By contrast, when determining that the subsequent print request is not present at the shutdown determination time, the image forming apparatus 200 controls such that at least driving of the photoconductors 3, application of the charging bias from the chargers 5 and the developing bias from the developing units 7 are stopped. Such control is performed by the control unit 140 in accordance with predetermined steps. In a case in which the subsequent print request is received during the shutdown sequence from when the control unit 140 determines that the subsequent print request is not present at the shutdown determination time to when the process to stop rotation of the surface of the photoconductors 3 is completed, the control unit 140 controls the image forming apparatus 200 such that subsequent image formation is performed in accordance with the subsequent print request without stopping rotation of the surface of the photoconductors 3. Accordingly, the period A in FIGS. 18 and 19 which is the total amount of time from when the control unit 140 issues a request to stop driving of the photoconductors 3 and the intermediate transfer belt 41 at completion of the shutdown sequence to when driving of the photoconductors 3 and the intermediate transfer belt 41 is actually stopped and the time from when the control unit 140 issues a request to start driving of the photoconductors 3 and the intermediate transfer belt 41 to when the rotational speed of the photoconductors 3 and the intermediate transfer belt 41 reaches the target speed, that is, the time required to be ready to start application of the charging bias in the startup sequence, can be reduced from downtime.

In particular, according to illustrative embodiments, when the control unit 140 determines that the subsequent print request is not present at the shutdown determination time, driving of the photoconductors 3 is stopped at the end of the shutdown sequence. In a case in which the subsequent print request is received during the shutdown sequence, the shutdown sequence is continued in accordance with the predetermined steps immediately before driving of the photoconductors 3 is stopped. Thereafter, the control unit 140 controls such that subsequent image formation is performed in accordance with the subsequent print request without stopping movement of the surface of the photoconductors 3. Accordingly, even when the subsequent print request is received at a step close to completion of the shutdown sequence, downtime can be prevented. In other words, a chance to prevent downtime can be increased.

According to illustrative embodiments, in a case in which the subsequent print request is received during the shutdown sequence and the control unit 140 controls such that subsequent image formation is performed in accordance with the subsequent print request, driving of the developing units 7 and application of the charging bias, the developing bias, the intermediate transfer bias, and the secondary bias, each of which is stopped in the shutdown sequence, are started in the same manner as the case of the startup sequence to perform subsequent image formation after driving of the photoconductors 3 and the intermediate transfer belt 41 is stopped without receiving the subsequent print request during the shutdown sequence. Accordingly, the startup sequence after receiving the subsequent print request during the shutdown sequence is performed in the same manner as the normal startup sequence, and control performed in a case in which the subsequent print request is received during the shutdown sequence can be simplified. As a result, a software configuration can be simplified, considerably reducing occurrence of malfunctions (bugs) generally caused by a too-complex software configuration.

When receiving the subsequent print request during the shutdown sequence, the control unit 140 determines whether or not to shut down the operations not yet shut down except driving of the photoconductors 3 and the intermediate transfer belt 41 in accordance with a predetermined requirement. The operations determined not to be shut down are continued until subsequent image formation. The operations determined to be shut down are shut down at a predetermined shutdown time, and are restarted at a predetermined startup time when subsequent image formation is started.

For example, when application of the charging bias is determined not to be stopped, it is determined that application of the developing bias is not to be stopped. By contrast, when application of the charging bias is already stopped or determined to be stopped, it is determined that application of the developing bias is to be stopped. Accordingly, the developer in the developing units 7 is prevented from being attached to the photoconductors 3.

Further, according to illustrative embodiments, the control unit 140 controls such that application of the developing bias, application of the charging bias, and driving of the photoconductors 3 are sequentially stopped in that order during the normal shutdown sequence, and driving of the photoconductors 3, application of the charging bias, and application of the developing bias are sequentially started in that order during the normal startup sequence. In a case in which the subsequent print request is received after stop of application of the developing bias is started and before stop of application of the charging bias is started, the operations shut down during the shutdown sequence except driving of the photoconductors 3 and application of the charging bias are sequentially started up, beginning from startup of driving of the developing units 7, in the same manner as the normal startup sequence without stopping application of the charging bias. Accordingly, downtime occurred when the subsequent print request is received before application of the developing bias is stopped and after application of the charging bias is stopped can be effectively solved. In addition, the operations shut down during the shutdown sequence except driving of the photoconductors 3 and application of the charging bias are started up in the same manner as the normal startup sequence. Accordingly, control processing of the startup sequence in a case in which the subsequent print request is received during the shutdown sequence can be simplified. As a result, a software configuration can be simplified, considerably reducing occurrence of malfunctions (bugs) generally caused by a too-complex software configuration.

According to illustrative embodiments, completion of intermediate transfer when transfer of the toner images from the photoconductors 3 onto the intermediate transfer belt 41 is completed is set as the shutdown determination time during the monochrome mode. Meanwhile, completion of secondary transfer when the toner image is transferred onto the recording sheet P is set as the shutdown determination time during the full-color mode. Accordingly, the image forming apparatus 200 can enter the waiting mode by immediately starting the shutdown sequence. Further, even when the subsequent print request is received during the shutdown sequence, image formation can be started in accordance with the subsequent print request with a shorter downtime. As a result, abrasion of the components in the image forming apparatus 200 can be prevented by immediately entering the waiting time with a shorter downtime.

In the foregoing illustrative embodiments, a tandem-type full-color image forming apparatus using an intermediate transfer method is described as the image forming apparatus 200. Additionally, the foregoing illustrative embodiments are also applicable to a single-drum type full-color image forming apparatus using a direct transfer method or a monochrome image forming apparatus.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. An image forming apparatus, comprising:

a latent image bearing member including a surface which is rotated to bear an electrostatic latent image;

a charging device to evenly charge the surface of the latent image bearing member;

an irradiating device to irradiate a charged surface of the latent image bearing member with a light beam according to image data to form an electrostatic latent image thereon;

a developing device to develop the electrostatic latent image with a developer to form a toner image on the charged surface of the latent image bearing member;

a transfer device to transfer the toner image onto a recording medium to form an image on the recording medium; and a control unit to control the image forming apparatus to perform subsequent image formation in accordance with a subsequent image forming request when it is determined that the subsequent image forming request is present at a predetermined determination time after completion of previous image formation, and to control the image forming apparatus to shut down certain predetermined operations, including at least rotation of the surface of the latent image bearing member and application of a charging bias from the charging device and a developing bias from the developing device in accordance with a predetermined shutdown sequence, when it is determined that the subsequent image forming request is not present at the predetermined determination time, wherein the control unit controls the image forming apparatus to start the subsequent image formation in accordance with the subsequent image forming request without stopping rotation of the surface of the latent image bearing member when the subsequent image forming request is received during a time between when the control unit determines that the subsequent image forming request is not present at the predetermined determination time and when a process to stop rotation of the surface of the latent image bearing member is completed, and when it is determined that the subsequent image forming request is not present at the predetermined determination time, the control unit sequentially stops application of the developing bias and the charging bias and rotation of the surface of the latent image bearing member in that order, and sequentially starts up rotation of the surface of the latent image bearing member and application of the charging bias and the developing bias in that order.

2. The image forming apparatus according to claim 1, wherein:

the control unit stops rotation of the surface of the latent image bearing member upon completion of the predetermined shutdown sequence when it is determined that the subsequent image forming request is not present at the predetermined determination time; and the control unit continues a process to shut down the certain predetermined operations in accordance with the predetermined shutdown sequence immediately before rotation of the surface of the latent image bearing member is stopped when the subsequent image forming request is received during the predetermined shutdown sequence, and thereafter controls the image forming apparatus to start the subsequent image formation in accordance with the subsequent image forming request without stopping rotation of the surface of the latent image bearing member.

3. The image forming apparatus according to claim 2, wherein, when controlling the image forming apparatus to start the subsequent image formation in accordance with the subsequent image forming request received during the predetermined shutdown sequence, the control unit restarts operations shut down during the predetermined shutdown sequence.

4. The image forming apparatus according to claim 1, wherein, when receiving the subsequent image forming request during the predetermined shutdown sequence, the control unit determines whether or not to shut down operations not yet shut down except rotation of the surface of the latent image bearing member in accordance with a predetermined requirement and causes operations determined not to be shut down to be continued until the subsequent image formation, while causing operations determined to be shut down to be shut down at a predetermined shutdown time and to restart operations, which were shut down, at a predetermined startup time to start the subsequent image formation.

5. The image forming apparatus according to claim 4, wherein, in a case in which application of the developing bias is included in the operations not yet shut down, the control unit determines not to stop application of the developing bias when application of the charging bias is determined not to be stopped, and determines to stop application of the developing bias when application of the charging bias is already stopped or determined to be stopped.

6. The image forming apparatus according to claim 1, wherein when receiving the subsequent image forming request after a process to stop application of the developing bias is started and before a process to stop application of the charging bias is started, the control unit does not stop application of the charging bias but starts up operations shut down during the predetermined shutdown sequence except rotation of the surface of the latent image bearing member and application of the charging bias.

7. The image forming apparatus according to claim 1, wherein the predetermined determination time corresponds to completion of transfer of the toner image from the latent image bearing member onto the transfer device.

8. The image forming apparatus according to claim 1, wherein the predetermined determination time corresponds to completion of transfer of the toner image onto the recording medium.

9. A control method for controlling an image forming apparatus, the image forming apparatus including: a latent image bearing member a surface of which is rotated to bear an electrostatic latent image, a charging device to evenly charge the surface of the latent image bearing member, an irradiating device to irradiate a charged surface of the latent image bearing member with a light beam according to image data to form an electrostatic latent image thereon, a developing device to develop the electrostatic latent image with a developer to form a toner image on the charged surface of the latent image bearing member, and a transfer device to transfer the toner image onto a recording medium to form an image on the recording medium, the control method comprising the steps of:

determining whether or not a subsequent image forming request is present at a predetermined determination time after completion of previous image formation;

upon determining that the subsequent image forming request is not present at the predetermined determination time, shutting down certain predetermined operations, including at least rotation of the surface of the latent image bearing member and application of a charging bias from the charging device and a developing bias from the developing device in accordance with a predetermined shutdown sequence;

starting subsequent image formation in accordance with the subsequent image forming request without stopping rotation of the surface of the latent image bearing member when the subsequent image forming request is received during a time between when it is determined that the subsequent image forming request is not present at the predetermined determination time and when a process to stop rotation of the surface of the latent image bearing member is completed; and when it is determined that the subsequent image forming request is not present at the predetermined determination time, sequentially stopping application of the developing bias and the charging bias and rotation of the surface of the latent image bearing member in that order, and sequentially starting up rotation of the surface of the latent image bearing member and application of the charging bias and the developing bias in that order.

10. The control method according to claim 9, further comprising the steps of:

stopping rotation of the surface of the latent image bearing member upon completion of the predetermined shutdown sequence when it is determined that the subsequent image forming request is not present at the predetermined determination time;

continuing a process to shut down the certain predetermined operations in accordance with the predetermined shutdown sequence immediately before rotation of the surface of the latent image bearing member is stopped when the subsequent image forming request is received during the predetermined shutdown sequence; and controlling the image forming apparatus to start the subsequent image formation in accordance with the subsequent image forming request without stopping rotation of the surface of the latent image bearing member.

11. The control method according to claim 10, further comprising the step of restarting operations shut down during the predetermined shutdown sequence when controlling the image forming apparatus to start the subsequent image formation in accordance with the subsequent image forming request received during the predetermined shutdown sequence.

12. The control method according to claim 9, further comprising the steps of:

when receiving the subsequent image forming request during the predetermined shutdown sequence, determining whether or not to shut down operations not yet shut down except rotation of the surface of the latent image bearing member in accordance with a predetermined requirement and causing operations determined not to be shut down to be continued until the subsequent image formation, while causing operations determined to be shut down to be shut down at a predetermined shutdown time; and restarting the operations at a predetermined startup time to start the subsequent image formation.

13. The control method according to claim 12, further comprising steps of:

in a case in which application of the developing bias is included in the operations not yet shut down, determining not to stop application of the developing bias when application of the charging bias is determined not to be stopped; and determining to stop application of the developing bias when application of the charging bias is already stopped or determined to be stopped.

14. The control method according to claim 9, further comprising step of, when receiving the subsequent image forming request after a process to stop application of the developing bias is started and before a process to stop application of the charging bias is started, continuing application of the charging bias while starting up the operations shut down during the predetermined shutdown sequence except rotation of the surface of the latent image bearing member and application of the charging bias.

15. The control method according to claim 9, wherein the predetermined determination time corresponds to completion of transfer of the toner image from the latent image bearing member onto the transfer device.

16. The control method according to claim 9, wherein the predetermined determination time corresponds to completion of transfer of the toner image onto the recording medium.

* * * * *